US008331822B2

(12) United States Patent
Kobayashi et al.

(10) Patent No.: US 8,331,822 B2
(45) Date of Patent: Dec. 11, 2012

(54) IMAGE FORMING APPARATUS AND IMAGE FORMING METHOD OF EFFECTIVELY DETECTING A SPEED DEVIATION PATTERN OF THE IMAGE FORMING APPARATUS

(75) Inventors: Kazuhiko Kobayashi, Tokyo (JP); Joh Ebara, Kamakura (JP); Yasuhisa Ehara, Kamakura (JP); Kouji Amanai, Yokohama (JP); Seiichi Handa, Tokyo (JP); Yuji Matsuda, Tokyo (JP); Toshiyuki Uchida, Kawasaki (JP); Noriaki Funamoto, Tokyo (JP); Keisuke Sugiyama, Yokohama (JP)

(73) Assignee: Ricoh Co., Ltd., Tokyo (JP)

( * ) Notice: Subject to any disclaimer, the term of this patent is extended or adjusted under 35 U.S.C. 154(b) by 0 days.

(21) Appl. No.: 13/039,012

(22) Filed: Mar. 2, 2011

(65) Prior Publication Data

US 2011/0150531 A1 Jun. 23, 2011

Related U.S. Application Data

(62) Division of application No. 11/677,013, filed on Feb. 20, 2007, now Pat. No. 7,937,007.

(30) Foreign Application Priority Data

Feb. 17, 2006 (JP) ..... 2006-040415

(51) Int. Cl.
*G03G 15/00* (2006.01)

(52) U.S. Cl. ..... 399/72; 399/167; 399/301; 347/116

(58) Field of Classification Search ..... 399/36, 399/49, 72, 167, 301
See application file for complete search history.

(56) References Cited

U.S. PATENT DOCUMENTS

| | | | | | |
|---|---|---|---|---|---|
| 4,884,105 | A | * | 11/1989 | Joseph et al. | 399/301 |
| 5,359,434 | A | * | 10/1994 | Nakao et al. | 358/481 |
| 5,734,108 | A | | 3/1998 | Walker et al. | |
| 5,881,346 | A | * | 3/1999 | Mori et al. | 399/301 |
| 5,995,802 | A | * | 11/1999 | Mori et al. | 399/394 |
| 6,038,423 | A | * | 3/2000 | Tagawa et al. | 399/301 |
| 6,049,690 | A | | 4/2000 | Nakayasu et al. | |
| 6,603,942 | B2 | * | 8/2003 | Asuwa et al. | 399/162 |

(Continued)

FOREIGN PATENT DOCUMENTS

EP 0 944 242 A2 9/1999

(Continued)

*Primary Examiner* — David Gray
*Assistant Examiner* — Geoffrey Evans
(74) *Attorney, Agent, or Firm* — Oblon, Spivak, McClelland, Maier & Neustadt, L.L.P.

(57) ABSTRACT

An image forming apparatus includes a plurality of image bearing members, each of which is configured to bear a portion of a pattern image including a plurality of reference images in a given form, an endless moving member facing the plurality of image bearing members and configured to receive the pattern image, an image detecting unit configured to detect the plurality of reference images, a rotational angle detecting unit configured to separately detect each image bearing member at a given rotational angle, and a controller configured to detect a speed deviation pattern for each revolution of each image bearing member. The controller is configured to detect the speed deviation pattern based on a result obtained from a phase component and a quadrature component of a frequency signal generated from the detection result obtained by the rotational angle detecting unit and a result of detecting the plurality of reference images in the pattern image transferred onto the endless moving member.

10 Claims, 18 Drawing Sheets

U.S. PATENT DOCUMENTS

| | | | | |
|---|---|---|---|---|
| 6,816,178 | B2 * | 11/2004 | Yamada et al. | 347/116 |
| 6,885,841 | B2 | 4/2005 | Harada et al. | |
| 7,343,123 | B2 * | 3/2008 | Kim et al. | 399/299 |
| 7,411,597 | B2 | 8/2008 | Noguchi et al. | |
| 7,587,157 | B2 | 9/2009 | Matsuda et al. | |
| 7,653,332 | B2 | 1/2010 | Ehara et al. | |
| 7,693,468 | B2 | 4/2010 | Ehara et al. | |
| 7,778,575 | B2 | 8/2010 | Matsuda et al. | |
| 8,064,809 | B2 * | 11/2011 | Yamaguchi et al. | 399/301 |
| 8,064,810 | B2 * | 11/2011 | Okumura et al. | 399/301 |
| 8,081,905 | B2 * | 12/2011 | Matsuda | 399/167 |
| 8,145,087 | B2 * | 3/2012 | Boldon et al. | 399/72 |
| 8,150,281 | B2 * | 4/2012 | Kawaguchi et al. | 399/49 |
| 8,165,502 | B2 * | 4/2012 | Matsuda | 399/167 |
| 2002/0136570 | A1 | 9/2002 | Yamanaka et al. | |
| 2003/0128995 | A1 * | 7/2003 | Ishii et al. | 399/49 |
| 2003/0210932 | A1 * | 11/2003 | Koide et al. | 399/302 |
| 2004/0052554 | A1 * | 3/2004 | Harada et al. | 399/301 |
| 2004/0184828 | A1 * | 9/2004 | Bannai et al. | 399/49 |
| 2005/0031361 | A1 * | 2/2005 | Kobayashi | 399/49 |
| 2005/0047834 | A1 | 3/2005 | Tomita et al. | |
| 2005/0207799 | A1 | 9/2005 | Ebara | |
| 2007/0253736 | A1 | 11/2007 | Ehara et al. | |
| 2007/0258729 | A1 | 11/2007 | Ehara et al. | |
| 2008/0013972 | A1 * | 1/2008 | Matsuda | 399/45 |
| 2008/0213000 | A1 * | 9/2008 | Funamoto et al. | 399/167 |
| 2008/0240754 | A1 | 10/2008 | Kobayashi et al. | |
| 2008/0240798 | A1 | 10/2008 | Murayama | |
| 2009/0238588 | A1 * | 9/2009 | Matsuda et al. | 399/46 |
| 2011/0097119 | A1 * | 4/2011 | Cho et al. | 399/301 |
| 2011/0206423 | A1 * | 8/2011 | Sugita et al. | 399/308 |
| 2011/0222870 | A1 * | 9/2011 | Miyagi | 399/15 |
| 2011/0222882 | A1 * | 9/2011 | Sugiyama et al. | 399/49 |
| 2012/0008995 | A1 * | 1/2012 | Shigemura et al. | 399/301 |
| 2012/0076524 | A1 * | 3/2012 | Furukawa | 399/72 |
| 2012/0107024 | A1 * | 5/2012 | Shimizu et al. | 399/301 |

FOREIGN PATENT DOCUMENTS

| | | | |
|---|---|---|---|
| EP | 1 460 485 | A1 | 9/2004 |
| EP | 1 510 875 | | 3/2005 |
| EP | 1 795 973 | A1 | 6/2007 |
| JP | 63-286864 | | 11/1988 |
| JP | 06-035287 | | 2/1994 |
| JP | 09-146329 | | 6/1997 |
| JP | 09193476 | A | 7/1997 |
| JP | 11-065208 | | 3/1999 |
| JP | 2001-142671 | | 5/2001 |
| JP | 2001188395 | A | 7/2001 |
| JP | 2004101655 | A | 4/2004 |

* cited by examiner

IMAGE FORMING APPARATUS AND IMAGE FORMING METHOD OF EFFECTIVELY DETECTING A SPEED DEVIATION PATTERN OF THE IMAGE FORMING APPARATUS

CROSS REFERENCE TO RELATED APPLICATIONS

This application is a divisional application of U.S. Ser. No. 11/677,013, filed Feb. 20, 2007, which claims priority to Japanese patent application no. 2006-040415, filed in the Japan Patent Office on Feb. 17, 2006, the disclosure of which is incorporated by reference herein in its entirety.

BACKGROUND OF THE INVENTION

1. Field of the Invention

The present invention generally relates to an image forming apparatus and an image forming method of effectively detecting a speed deviation pattern of the image forming apparatus, and more particularly relates to an image forming apparatus that can effectively detect a speed deviation pattern of an image bearing member included in the image forming apparatus with high accuracy, and an image forming method of effectively detecting the speed deviation pattern of the image forming apparatus.

2. Discussion of the Related Art

An image forming apparatus using electrophotography may include a plurality of image bearing members such as photoconductors, and a transfer member (e.g., transfer belt) that may be disposed facing the image bearing members. The transfer member may travel in an endless manner in one direction.

In such image forming apparatus, toner images having different color may be formed on each of the image bearing members.

Such toner images may be superimposingly transferred directly onto a recording medium (e.g., transfer sheet) that is conveyed on and by a transfer member. By performing the above-described action, a full-color toner image may be formed on the recording medium. This is a direct transfer method.

Instead of the above-described direct transfer method, an indirect transfer method may also be used.

In the indirect transfer method, toner images may be superimposingly transferred onto the transfer member, then transferred onto a recording medium to form a full-color toner image thereon.

In such configuration, sometimes, toner images may not be correctly superimposed on the recording medium by several factors. Such factors may include an eccentricity of a photoconductor serving as an image bearing member, an eccentricity of a drive-force transmitting member (e.g., a photoconductor gear) that concentrically rotates with the photoconductor, and an eccentricity of a coupling that is connected to the photoconductor, for example.

Specifically, if the photoconductor or the drive-force transmitting member may have an eccentricity, the photoconductor may have two areas (e.g., first and second areas) on a surface of photoconductor with respect to a diameter direction of the photoconductor.

For example, the first area of the photoconductor may rotate with a relatively faster speed due to the eccentricity, and the second area of the photoconductor may rotate with a relatively slower speed due to the eccentricity, wherein such first and second areas may be distanced from each other by 180 degrees with respect to a diameter direction of the photoconductor, for example.

In such a case, first image dots formed on the first area of the surface of the photoconductor may be transferred to a transfer member at a timing earlier than an optimal timing, and second image dots formed on the second area of the surface of the photoconductor may be transferred to the transfer member at a timing later than an optimal timing.

If such phenomenon may occur, the first image dots formed on a surface of a photoconductor may be superimposed on the second image dots formed on a surface of a different photoconductor. Similarly, the second image dots formed on a surface of a photoconductor may be superimposed with the first image dots formed on a surface of a different photoconductor.

Such phenomenon may cause incorrect superimposing of toner images having different colors.

In another image forming apparatus, a controller may conduct a speed deviation checking and a phase adjustment control for toner images to reduce an incorrect superimposing of toner images.

The speed deviation checking may be conducted by detecting a deviation of a surface speed of an image bearing member (e.g., a photoconductor) when conducting an image forming operation.

The phase adjustment control may be conducted by adjusting a phase of each image bearing member based on the speed deviation checking.

In a case in which the speed deviation checking is conducted, a plurality of toner images may be formed with a given pitch from each other on a surface of an image bearing member in a surface moving direction of the image bearing member.

Such plurality of toner images may be then transferred onto a transfer member (e.g., a transfer belt) as a pattern image, and a photosensor may detect each of the toner images included in the pattern image.

Based on a detection result by the photosensor, a pitch of toner images included in the pattern image may be computed.

Based on the computed pitch, a speed deviation per one revolution of each of the image bearing members may be determined.

Furthermore, another photosensor may detect a marking placed on a photoconductor gear, which rotates the image bearing member, to detect a timing when the image bearing member comes to a given rotational angle.

With such process, the controller of the image forming apparatus may compute a difference between a first timing when the image bearing member comes to the given rotational angle and a second timing when the surface speed of the image bearing member becomes a maximum or minimum speed.

Such process may be conducted for each of the image bearing members.

After such speed deviation checking has been conducted, a phase adjustment control may be conducted to adjust a phase of image bearing members.

Specifically, a photosensor may detect a marking placed on a given position of a photoconductor gear, which rotates with a photoconductor serving as an image bearing member.

A plurality of photosensors may be used to detect a marking placed on a given position of photoconductor gears, which rotates respective photoconductors.

With such process, a timing when each of the photoconductors becomes a given rotational angle may be detected.

Based on such information including rotational angle and speed deviation of the respective photoconductors, a plurality of drive motors, which respectively drive each of the photoconductors, are driven by changing a driving time period temporarily to adjust a phase of the photoconductors.

With such phase adjustment of photoconductors, image dots that may come to a transfer position at an earlier timing than an optimal timing, or image dots that may come to a transfer position at a later timing than an optimal timing, may come to a transfer position at an optimal timing.

With such controlling, a superimposing deviation of images may be reduced.

In an image forming apparatus having such configuration, a speed deviation pattern of a photoconductor due to an eccentricity of the photoconductor may be detected.

For detecting such speed deviation pattern with high accuracy, however, the photoconductor of the image forming apparatus may need to be rotated for several times to detect the speed deviation of the photoconductor, so that a speed deviation component due to a factor different from an eccentricity of the photoconductor may be removed.

Hereinafter, a speed deviation component due to a factor different from an eccentricity of a photoconductor will be referred to as a "speed deviation component independent from a photoconductor."

The speed deviation component independent from a photoconductor may include a component of belt speed deviation due to an eccentricity of a drive roller that may drive an intermediate transfer belt, for example.

A speed deviation checking pattern image that can be extendedly formed over a surface of a photoconductor for several revolutions of the photoconductor may be formed and detected.

However, patch toner images of the speed deviation checking pattern image may be formed at a relatively different position for each revolution or rotation cycle of the photoconductor. That is, the patch toner images may have a relative positional deviation for each revolution or rotation cycle of the photoconductor.

Specifically, a patch toner image in a speed deviation checking pattern image may need to be formed at design pitches or pitches that may be set according to a resolution of the image forming apparatus.

For example, when an image forming apparatus has a resolution of 600 dpi, a dot formation pitch between patch toner images may be approximately 42 μm. Accordingly, the pitch for forming the patch toner images may be obtained by multiplying the dot formation pitch of approximately 42 μm with an integer number (e.g., one, two, three).

Then, each patch toner image may be formed at a time interval corresponding to the pitch to detect a speed deviation pattern based on a pitch deviation of an actually formed patch toner image of the speed deviation checking pattern image.

In general, however, the pitch of patch toner images may not be equal to a value obtained by multiplying a circumferential length of a photoconductor with an integer number (e.g., one, two, three). Therefore, the circumferential length of the photoconductor cannot be divided by the pitch of patch toner images.

For example, a speed deviation checking pattern image that can be extendedly formed over a surface of a photoconductor for several revolutions of the photoconductor may be formed against the above-described fact.

If a first patch toner image for a first revolution of the photoconductor is formed at a given position on the photoconductor, a first patch toner image for a second revolution of the photoconductor may be formed at a different position slightly apart from the given position.

Each first patch toner image for respective revolutions after the second revolution of the photoconductor may be formed at a different position slightly away from the position at which the first patch toner image for the previous revolution is formed.

When such positional deviation of patch toner images occurs, speed data based on a detection timing of each patch toner image for each revolution of the photoconductor may not synchronize with each other.

It is known to conduct synchronous addition processing to remove a speed deviation component of an image forming unit independent from the photoconductor. However, to remove such a speed deviation component, speed data for each revolution of the photoconductor may need to be corrected to synchronize with each other.

This, however, may cause complex arithmetic processing for synchronizing speed data of each revolution of the photoconductor.

To avoid such complex arithmetic processing, when the photoconductor comes to a given rotational angle of each revolution, speed data for each revolution may be synchronized with each other and a first patch toner image for each revolution may be formed at the same position.

In this case, an expensive and highly responsive detecting unit detecting the above-described rotational angle may be required. Otherwise, a positional deviation of a patch toner image caused by response speed deviation of the above-described detecting unit for each revolution may occur.

Accordingly, it may become difficult to detect a speed deviation checking pattern image with desired accuracy.

SUMMARY OF THE INVENTION

Exemplary aspects of the present invention have been made in view of the above-described circumstances.

Exemplary aspects of the present invention provide an image forming apparatus that can detect a speed deviation pattern of an image bearing member with high accuracy, forming a pattern image at a timing that the pattern image is formed in a rotation direction of each image bearing member at a pitch being obtained by dividing a circumferential length of each image bearing member by a non-integer number.

Other exemplary aspects of the present invention provide an image bearing member that can detect a speed deviation pattern of an image bearing member with high accuracy, forming a pattern image at a timing that the pattern image is formed in a rotation direction of each image bearing member at a pitch thereof obtained by dividing a circumferential length of each image bearing member by an integer number.

Other exemplary aspects of the present invention provide a method of effectively detecting a speed deviation pattern using either one of the above-described image forming apparatuses.

In one exemplary embodiment, an image forming apparatus includes a plurality of image bearing members, each of which is configured to bear a portion of a pattern image including a plurality of reference images in a given form and each portion of the pattern image being arranged on the surface of each image bearing member in a rotation direction of each image bearing member, an endless moving member disposed facing the plurality of image bearing members and configured to receive the pattern image from the plurality of image bearing members, an image detecting unit configured to detect the plurality of reference images in the pattern image transferred onto the endless moving member, a rotational angle detecting unit configured to separately detect each image bearing member when each image bearing member comes to a given rotational angle, and a controller configured to detect a speed deviation pattern per one revolution of each image bearing member based on a detection timing of each of the plurality of reference images by the image detecting unit and a detection result obtained by the rotational angle detecting unit, conduct a phase adjustment control for adjusting a phase of the speed deviation pattern of the plurality of image bearing members, and control formation of the reference images in the pattern image at a timing that the reference images of the pattern image are formed in a rotation direction of each image bearing member at a pitch thereof being obtained by dividing a circumferential length of each image bearing member by a non-integer number. With such configuration of the image forming apparatus, the controller is configured to detect the speed deviation pattern based on a result obtained from a phase component and a quadrature component of a frequency signal generated from the detection result obtained by the rotational angle detecting unit and a result of detecting the plurality of reference images in the pattern image transferred onto the endless moving member.

The controller may be configured to control formation of the pattern image having a circumferential length thereof in the rotation direction of each image bearing member greater than the circumferential length of each image bearing member, at a timing that the plurality of reference images in the pattern image are arranged at equal pitches in the rotation direction of each image bearing member.

The image detecting unit may be configured to detect the plurality of reference images of the pattern image while the plurality of reference images are separately transferred onto at least two different portions on the surface of the endless moving member in a direction perpendicular to a traveling direction of the endless moving member. The controller may be configured to control a formation of the plurality of reference images of the pattern image from the surface of each image bearing member onto the surface of the endless moving member, at a timing that respective portions of the pattern image of at least two image bearing members of the plurality of image bearing members are transferred onto the surface of the endless moving member on different lateral sides in the direction perpendicular to the traveling direction of the endless moving member.

The plurality of image bearing members may include one reference image bearing member, and each of the portions of the pattern image corresponding to respective image bearing members other than the reference image bearing member among the plurality of image bearing members may be arranged with one of the portions of the pattern image corresponding to the reference image bearing member on different lateral sides in the direction perpendicular to the traveling direction of the endless moving member.

The image detecting unit may include a plurality of sensors of an equal or greater number of the plurality of image bearing members so that the plurality of sensors detect the plurality of reference images of the pattern image at different positions in the direction perpendicular to the traveling direction of the endless moving member on the surface of the endless moving member. The controller may be configured to control formation of the pattern images on the surface of a corresponding image bearing member of the plurality of image bearing members on different lateral portions in the direction perpendicular to the traveling direction of the endless moving member.

The controller may be configured to control formation of the portions of the pattern images at a timing that a leading edge of the portion of the pattern image corresponding to the reference image bearing member and respective leading edges of the portions of the pattern image corresponding to each image bearing member other than the reference image bearing member of the plurality of image bearing members are arranged at respective same positions on the surface of the endless moving member in the traveling direction of the endless moving member.

The above-described image forming apparatus may further include a plurality of drive sources, each of which is configured to drive each of the plurality of image bearing members. With such configuration of the image forming apparatus, the controller may be configured to start the plurality of drive sources, stop the plurality of drive sources at a given reference timing based on the detection result obtained by the rotational angle detecting unit, restart the plurality of drive sources, and conduct the speed deviation checking.

Further, in one exemplary embodiment, an image forming apparatus includes a plurality of image bearing members, each of which is configured to bear a portion of a pattern image including a plurality of reference images in a given form and each portion of the pattern image being arranged on the surface of each image bearing member in a rotation direction of each image bearing member, an endless moving member disposed facing the plurality of image bearing members and configured to receive the pattern image from each of the plurality of image bearing members, an image detecting unit configured to detect the plurality of reference images in the pattern image transferred onto the endless moving member, a rotational angle detecting unit configured to separately detect each image bearing member when each image bearing member comes to a given rotational angle, and a controller configured to detect a speed deviation pattern per one revolution of each image bearing member based on a detection timing of each of the plurality of reference images by the image detecting unit and a detection result obtained by the rotational angle detecting unit and conduct a phase adjustment control for adjusting a phase of the speed deviation pattern of the plurality of image bearing members. With such configuration of the image forming apparatus, a circumferential length of each of the plurality of image bearing members in a rotation direction of each image bearing member is equal to a dot formation pitch in the rotation direction of each image bearing member multiplied with a first integer number, and the controller is configured to control forming the reference images in the pattern image at a timing that the reference images of the pattern image are formed in a rotation direction of each image bearing member at a pitch thereof being obtained by dividing the circumferential length of each image bearing member by a second integer number.

The controller may be configured to detect the speed deviation pattern based on the detection result obtained by the rotational angle detecting unit and a result of synchronously adding multiple speed data information for each revolution of each image bearing member, the multiple speed data information determined from a result of detecting the plurality of reference images in the pattern image transferred onto the endless moving member.

The above-described image forming apparatus may further include a plurality of drive sources, each of which configured to drive each of the plurality of image bearing members. With such configuration of the image forming apparatus, the controller may be configured to start the plurality of drive sources, stop the plurality of drive sources at a given reference timing based on the detection result obtained by the rotational angle detecting unit, restart the plurality of drive sources, and conduct the speed deviation checking.

Further, in one exemplary embodiment, a method of detecting a speed deviation pattern of an image forming apparatus includes starting a plurality of drive sources respectively driving a plurality of image bearing members, stopping the plurality of drive sources at a given reference timing based on a detection result obtained by a rotational angle detecting unit separately detecting each image bearing member when each image bearing member comes to a given rotational angle, restarting the plurality of drive sources, and detecting a speed deviation pattern per one revolution of each image bearing member, based on a detection timing of each of a plurality of reference images obtained by an image detecting unit for detecting the plurality of reference images in the pattern image transferred onto an endless moving member and the detection result obtained from a phase component and quadrature component of a frequency signal generated from the detection result obtained by the rotational angle detecting unit and a result of detecting the plurality of reference images in the pattern image transferred onto the endless moving member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
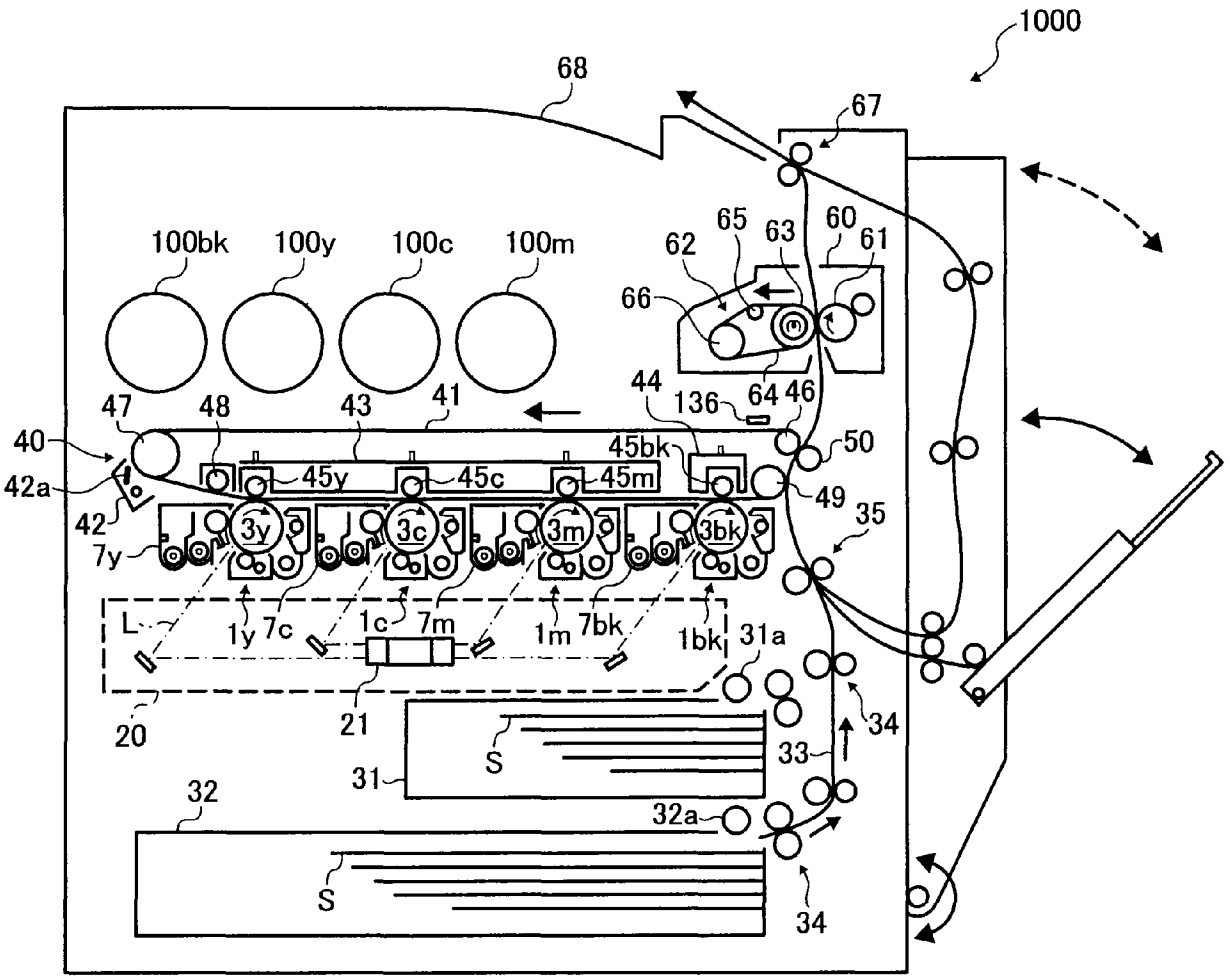
FIG. 1 is a schematic configuration of an image forming apparatus according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

FIG. 1 is a schematic configuration of the image forming apparatus 1000 according to a first exemplary embodiment of the present invention. The image forming apparatus 1000 may be used as a printer, for example, but not limited a printer.

As shown in FIG. 1, the image forming apparatus 1000 may include process units 1*y*, 1*c*, 1*m*, and 1*bk*, for example.

Each of the process units 1*y*, 1*c*, 1*m*, and 1*bk* may be used to form a toner image of yellow, magenta, cyan, and black, respectively. Hereinafter, reference characters of "y", "c", "m", and "bk" are used to indicate each color of yellow, magenta, cyan, and black, as required.

The process units 1*y*, 1*c*, 1*m*, and 1*bk* may have a similar configuration for forming a toner image, except toner colors (i.e., yellow, cyan, magenta, and black toner).

Figure 2:
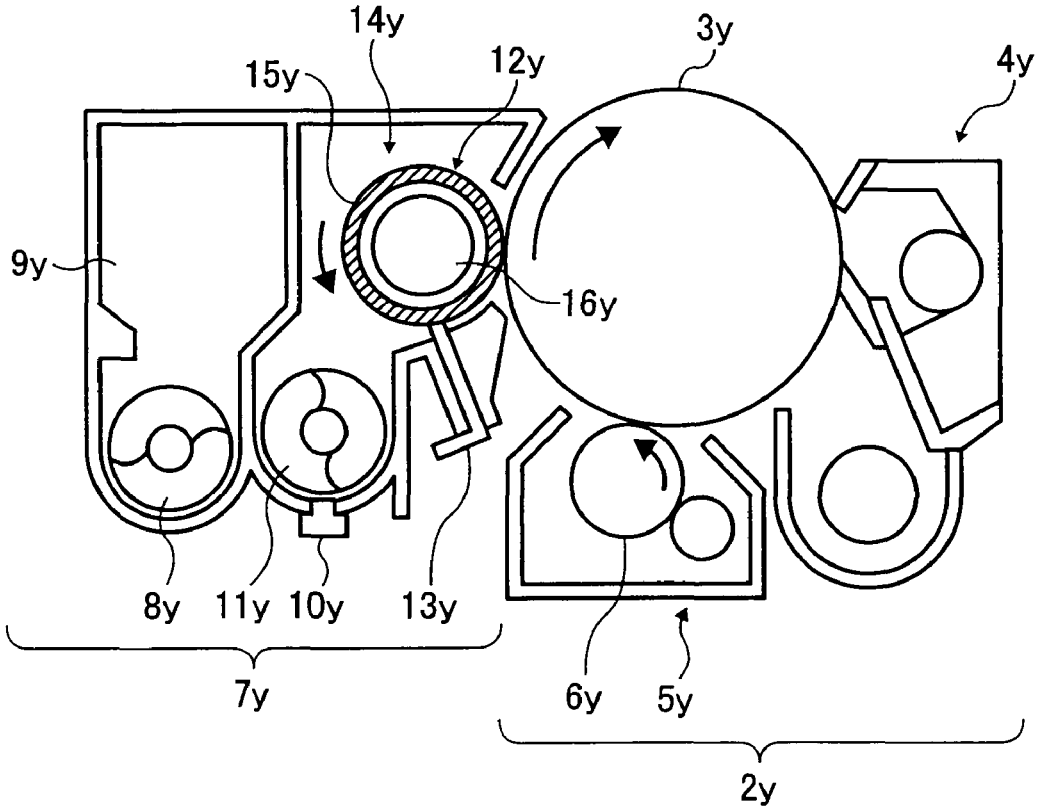
FIG. 2 is a schematic configuration of a process unit of the image forming apparatus of FIG. 1.

For example, the process unit 1*y* for forming a yellow toner image may include a photoconductive unit 2*y*, and a developing unit 7*y*, as shown in FIG. 2.

Figure 3:
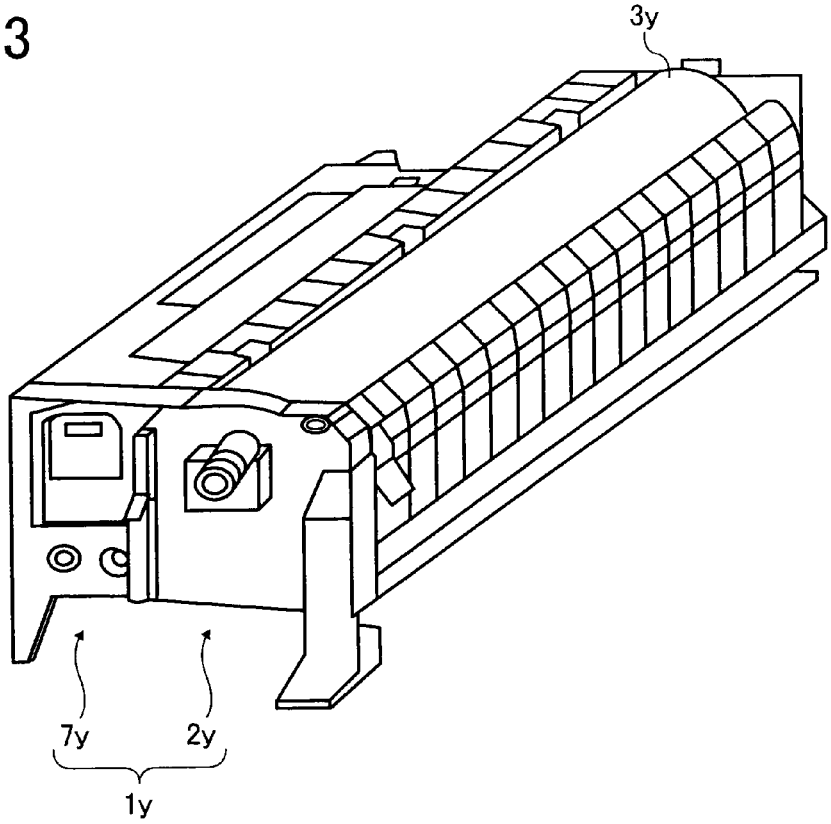
FIG. 3 is a perspective view of a process unit of FIG. 2.

The photoconductive unit 2*y* and the developing unit 7*y* may be integrally mounted as the process unit 1*y*, as shown in FIG. 3. Such process unit 1*y* may be detachable with respect to the image forming apparatus 1000.

Figure 4:
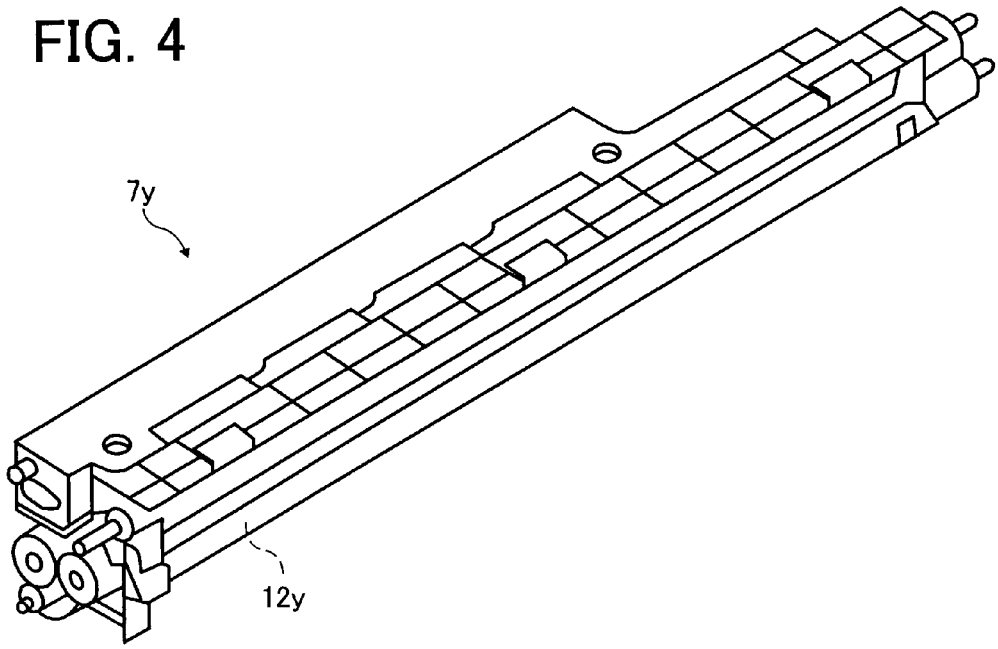
FIG. 4 is a perspective view of a developing unit included in the process unit of FIG. 2.

When the process unit 1*y* is removed from the image forming apparatus 1000, the developing unit 7*y* may be further detachable with respect to the photoconductive unit 2*y*, as shown in FIG. 4.

As shown in FIG. 2, the photoconductive unit 2*y* may include a photoconductor 3*y*, a drum cleaning unit 4*y*, a charging unit 5*y*, and a discharging unit (not shown), for example.

The photoconductor 3*y*, used as an image bearing member, may have a drum shape, for example.

The charging unit 5*y* may uniformly charge a surface of the photoconductor 3*y*, which may rotate in a clockwise direction in FIG. 2 by a driver (not shown).

The charging unit 5*y* may include a contact type charger such as charging roller 6*y* as shown in FIG. 2, for example.

The charging roller 6*y* may be supplied with a charging bias voltage from a power source (not shown), and may rotate in a counterclockwise direction when to uniformly charge the photoconductor 3*y*. Instead of the charging roller 6*y*, the charging unit 5*y* may include a charging brush, for example.

Furthermore, the charging unit 5*y* may include a non-contact type charger, such as a scorotron charger (not shown), to uniformly charge the surface of the photoconductor 3*y*.

The surface of the photoconductor 3*y*, which may be uniformly charged by the charging unit 5*y*, may be scanned by a laser light beam, which is emitted from an optical writing unit 20, to form an electrostatic latent image for a yellow image on the surface of the photoconductor 3*y*.

As shown in FIG. 2, the developing unit 7*y* may include a first developer container 9*y* having a first conveying screw 8*y* therein, for example.

The developing unit 7*y* may further include a second developer container 14*y* having a toner concentration sensor 10*y*, a second conveying screw 11*y*, a developing roller 12*y*, and a doctor blade 13*y*, for example.

The toner concentration sensor 10*y* may include a magnetic permeability sensor, for example.

The first and second developer containers 9*y* and 14*y* may contain a yellow developing agent having magnetic carrier and yellow toner. The yellow toner may be negatively charged, for example.

The first conveying screw 8*y*, rotated by a driver (not shown), may convey the yellow developing agent to one end direction of the first developer container 9*y*.

Then, the yellow developing agent may be conveyed into the second developer container 14*y* through an opening (not shown) of a separation wall, provided between the first developer container 9*y* and the second developer container 14*y*.

The second conveying screw 11*y*, rotated in the second developer container 14*y* by a driver (not shown), may convey the yellow developing agent to one end direction of the second developer container 14*y*.

The toner concentration sensor 10*y*, attached to a bottom of the second developer container 14*y*, may detect toner concentration in the yellow developing agent being conveyed in the second developer container 14*y*.

As shown in FIG. 2, the developing roller 12*y* may be provided over the second conveying screw 11*y* while the developing roller 12*y* and second conveying screw 11*y* may be provided in the second developer container 14*y* in a parallel manner.

As shown in FIG. 2, the developing roller 12*y* may include a developing sleeve 15*y*, and a magnet roller 16*y*, for example.

The developing sleeve 15*y* may be made of non-magnetic material and formed in a pipe shape, for example. The magnet roller 16*y* may be included in the developing sleeve 15*y*, for example.

When the developing sleeve 15*y* may rotate in a counterclockwise direction in FIG. 2, a portion of the yellow developing agent, conveyed by the second conveying screw 11*y*, may be carried-up to a surface of the developing sleeve 15*y* with an effect of magnetic force of the magnet roller 16*y*.

Then, the doctor blade 13*y*, provided over the developing sleeve 15*y* with a given space therebetween, may regulate a thickness of layer of the yellow developing agent on the developing sleeve 15*y*.

Such thickness-regulated yellow developing agent may be conveyed to a developing area, which faces the photoconductor 3*y*, with a rotation of the developing sleeve 15*y*.

Then, yellow toner in the yellow developing agent may be conveyed to an electrostatic latent image formed on the surface of the photoconductor 3*y* to develop a yellow toner image on the surface of the photoconductor 3*y*.

The yellow developing agent, which loses the yellow toner by such developing process, may be returned to the second conveying screw 11*y* with a rotation of the developing sleeve 15*y*.

Then, the yellow developing agent may be conveyed by the second conveying screw 11*y* and returned to the first developer container 9*y* through an opening (not shown) of the separation wall.

The toner concentration sensor 10*y* may detect permeability of the yellow developing agent, and transmit a detected permeability to a controller 200 (see FIG. 13) of the image forming apparatus 1000 as voltage signal.

The permeability of yellow developing agent may correlate with a yellow toner concentration in the yellow developing agent.

Accordingly, the toner concentration sensor 10*y* may output a voltage signal corresponding to an actual yellow toner concentration in the second developer container 14*y*.

The controller 200 may include a random access memory or RAM, which stores a reference value "Vtref" for voltage signal transmitted from the toner concentration sensor 10*y*. The reference value "Vtref" may be set to a value, which is preferable for developing process.

The reference value "Vtref" may be set to a preferable toner concentration for each of yellow toner, cyan toner, magenta toner, and black toner.

The RAM may store such preferable toner concentration value as data.

In case of the developing unit 7*y*, the controller 200 may compare a reference value "Vtref" for yellow toner concentration and an actual voltage signal coming from the toner concentration sensor 10*y*.

Then, the controller 200 may drive a toner supplying unit (not shown) for a given time period based on the above-described comparison to supply fresh yellow toner to the developing unit 7*y*.

With such process, fresh yellow toner may be supplied to the first developer container 9*y*, as required, by which a yellow toner concentration in the yellow developing agent in the first developer container 9*y* may be set to a preferable level after the developing process, which consumes yellow toner.

Accordingly, yellow toner concentration in the yellow developing agent in the second developer container 14*y* may be maintained at a given range.

Such toner supply control may be similarly performed for other process units 1*c*, 1*m*, and 1*bk*, using different color toners with developing agent.

The yellow toner image formed on the photoconductor 3*y* may be then transferred to an intermediate transfer belt 41, which will be descried later.

After transferring a yellow toner image to the intermediate transfer belt 41, the drum cleaning unit 4*y* of the photoconductive unit 2*y* may remove residual toner remaining on the surface of the photoconductor 3*y*.

Then, the discharging unit (not shown) may remove the electric charge from the surface of the photoconductor 3*y* to prepare for a next image forming operation.

A similar transferring process for toner images may be performed for other process units 1*c*, 1*m*, and 1*bk*. Specifically, cyan, magenta, and black toner images may be transferred to the intermediate transfer belt 41 from the respective photoconductors 3*c*, 3*m*, and 3*bk*, as similar to the photoconductor 3*y*.

As shown in FIG. 1, the image forming apparatus 1000 may include the optical writing unit 20 under the process units 1*y*, 1*c*, 1*m*, and 1*bk*, for example.

The optical writing unit 20 may irradiate the laser light beam L to each of the photoconductors 3*y*, 3*c*, 3*m*, and 3*bk* of the respective process units 1*y*, 1*c*, 1*m*, and 1*bk* based on original image information.

With such process, electrostatic latent images for yellow, cyan, magenta, and black colors may be formed on the respective photoconductors 3*y*, 3*c*, 3*m*, and 3*bk*.

The optical writing unit 20 may irradiate the laser light beam L to the photoconductors 3*y*, 3*c*, 3*m*, and 3*bk* with a polygon mirror 21 and other optical components such as lens and mirrors.

The polygon mirror 21, rotated by a motor (not shown), may deflect a laser light beam coming from a light source (not shown). Such light beam then goes via the plurality of optical components to the photoconductors 3*y*, 3*c*, 3*m*, and 3*bk*.

The optical writing unit 20 may include another structure such as a light emitting diode (or LED) array for scanning the photoconductors 3*y*, 3*c*, 3*m*, and 3*bk*, for example.

The image forming apparatus 1000 may further include a first sheet cassette 31 and a second sheet cassette 32 under the optical writing unit 20, for example.

As shown in FIG. 1, the first sheet cassette 31 and the second sheet cassette 32 may be provided in a vertical direction each other, for example.

The first sheet cassette 31 and the second sheet cassette 32 may store a bundle of sheets as recording media.

A top sheet in the first sheet cassette 31 or the second sheet cassette 32 is referred as a recording sheet S. The recording sheet S may contact to a first sheet feeding roller 31*a* or a second sheet feeding roller 32*a*.

When the first sheet feeding roller 31*a*, driven by a driver (not shown), may rotate in a counterclockwise direction in FIG. 1, the recording sheet S in the first sheet cassette 31 may be fed to a sheet feeding route 33, which extends in a vertical direction in a right side of the image forming apparatus 1000 in FIG. 1.

Similarly, when the second sheet feeding roller 32*a*, driven by a driver (not shown), may rotate in a counterclockwise direction in FIG. 1, the recording sheet S in the second sheet cassette 32 may be fed to the sheet feeding route 33.

The sheet feeding route 33 may be provided with a plurality of pairs of conveying rollers 34 as shown in FIG. 1.

The plurality of pairs of conveying rollers 34 may convey the recording sheet S in one direction in the sheet feeding route 33 (e.g., from the lower direction to the upper direction in the sheet feeding route 33).

The sheet feeding route 33 may also be provided with a pair of registration rollers 35 at the end of the sheet feeding route 33.

The pair of registration rollers 35 may receive the recording sheet S, fed by the pairs of conveying rollers 34, and then the pair of registration rollers 35 may stop its rotation temporarily.

Then, the pair of registration rollers 35 may feed the recording sheet S to a secondary transfer nip (to be described later) at a given timing.

As shown in FIG. 1, the image forming apparatus 1000 may further include a transfer unit 40 over the process units 1*y*, 1*c*, 1*m*, and 1*bk*, for example.

The transfer unit 40 may include an intermediate transfer belt 41, a belt cleaning unit 42, a first bracket 43, a second bracket 44, primary transfer rollers 45*y*, 45*c*, 45*m*, and 45*bk*, a back-up roller 46, a drive roller 47, a support roller 48, and a tension roller 49, for example.

The intermediate transfer belt 41, which serves as an endless moving member, may be extended by the primary transfer rollers 45*y*, 45*c*, 45*m*, and 45*bk*, the back-up roller 46, the drive roller 47, the support roller 48, and the tension roller 49.

The intermediate transfer belt 41 may travel in a counterclockwise direction in FIG. 1 in an endless manner with a driving force of the drive roller 47.

The primary transfer rollers 45*y*, 45*c*, 45*m*, and 45*bk*, the photoconductors 3*y*, 3*c*, 3*m*, and 3*bk* may form primary transfer nips respectively while sandwiching the intermediate transfer belt 41 therebetween.

The primary transfer rollers 45*y*, 45*c*, 45*m*, and 45*bk* may apply a primary transfer biasing voltage, supplied from a power source (not shown), to an inner face of the intermediate transfer belt 41.

The primary transfer biasing voltage may have an opposite polarity (e.g., positive polarity) with respect to toner polarity (e.g., negative polarity).

The intermediate transfer belt 41 traveling in an endless manner may receive the yellow, cyan, magenta, and black toner images from the photoconductors 3*y*, 3*c*, 3*m*, and 3*bk* at the primary transfer nips for yellow, cyan, magenta, and black toner images in a superimposing and sequential manner, by which the yellow, cyan, magenta, and black toner images may be transferred to the intermediate transfer belt 41.

Accordingly, the intermediate transfer belt 41 may have a four-color (or full color) toner image thereon.

As shown in FIG. 1, a secondary transfer roller 50 that is provided over an outer face of the intermediate transfer belt 41 may form a secondary transfer nip with the back-up roller 46 while sandwiching the intermediate transfer belt 41 therebetween.

The pair of registration rollers 35 may feed the recording sheet S to the secondary transfer nip at a given timing, which is synchronized to a timing for forming the four-color toner image on the intermediate transfer belt 41.

The secondary transfer roller 50 and the back-up roller 46 may generate a secondary transfer electric field therebetween.

The four-color toner image formed on the intermediate transfer belt 41 may be transferred to the recording sheet S at the secondary transfer nip with an effect of the secondary transfer electric field and nip pressure.

After transferring toner images at the secondary transfer nip to the recording sheet S, some toner particles may remain on the intermediate transfer belt 41.

The belt cleaning unit 42 may remove such remaining toner particles from the intermediate transfer belt 41.

The belt cleaning unit 42 may remove toner particles remaining on the intermediate transfer belt 41 by contacting a cleaning blade 42*a* on the outer face of the intermediate transfer belt 41, for example.

The first bracket 43 of the transfer unit 40 may pivot with a given rotational angle at an axis of the support roller 48 with an ON/OFF of solenoid (not shown).

In case of forming a monochrome image with the image forming apparatus 1000, the first bracket 43 may be rotated in a counterclockwise direction in FIG. 1 for some degree by activating the solenoid.

With such rotating movement of the first bracket 43, the primary transfer rollers 45*y*, 45*c*, and 45*m* may revolve in a counterclockwise direction around the support roller 48.

With the above-described process, the intermediate transfer belt 41 may be spaced apart from the photoconductors 3*y*, 3*c*, and 3*m*.

Accordingly, a monochrome image can be formed on the recording sheet by driving the process unit 1*bk* while stopping other process units 1*y*, 1*c*, and 1*m*.

Such configuration may preferably reduce or suppress an aging of the process units 1*y*, 1*c*, and 1*m* because the process units 1*y*, 1*c*, and 1*m* may not be driven when a monochrome image forming is conducted.

As shown in FIG. 1, the image forming apparatus 1000 may include a fixing unit 60 over the secondary transfer nip, for example.

The fixing unit 60 may include a pressure roller 61 and a fixing belt unit 62, for example.

The fixing belt unit 62 may include a fixing belt 64, a heat roller 63, a tension roller 65, a drive roller 66, and a temperature sensor (not shown), for example.

The heat roller 63 may include a heat source such as halogen lamp, for example.

The fixing belt 64, extended by the heat roller 63, the tension roller 65, and the drive roller 66, may travel in a counterclockwise direction in an endless manner. During such traveling movement of the fixing belt 64, the heat roller 63 may heat the fixing belt 64.

As shown in FIG. 1, the pressure roller 61 facing the heat roller 63 may contact an outer face of the heated fixing belt 64. Accordingly, the pressure roller 61 and the fixing belt 64 may form a fixing nip.

The temperature sensor (not shown) may be provided over an outer face of the fixing belt 64 with a given space and near the fixing nip so that the temperature sensor may detect a surface temperature of the fixing belt 64, which is just going into the fixing nip.

The temperature sensor transmits a detected temperature to a power source circuit (not shown) as a signal. Based on such signal, the power source circuit may control a power ON/OFF to the heat source in the heat roller 63, for example.

With such controlling, the surface temperature of fixing belt 64 may be maintained at a given level such as approximately 140 degree Celsius, for example.

The recording sheet S that has passed through the secondary transfer nip may then be transported to the fixing unit 60.

The fixing unit 60 may apply pressure and heat to the recording sheet S at the fixing nip to fix the four-color toner image on the recording sheet S.

After the fixing process, the recording sheet S may be discharged to an outside of the image forming apparatus 1000 with a pair of sheet discharging rollers 67.

The image forming apparatus 1000 may further include a sheet stack 68 on a top of the image forming apparatus 1000. The recording sheet S discharged by the pair of sheet discharging rollers 67 may be stacked on the sheet stack 68.

The image forming apparatus 1000 may further include toner cartridges 100*y*, 100*c*, 100*m*, and 100*bk* over the transfer unit 40. The toner cartridges 100*y*, 100*c*, 100*m*, and 100*bk* may store yellow, cyan, magenta, and black toners, respectively.

The yellow, cyan, magenta, and black toners may be supplied from the toner cartridges 100*y*, 100*c*, 100*m*, and 100*bk* to the developing unit 7*y*, 7*c*, 7*m*, and 7*bk* of the process units 1*y*, 1*c*, 1*m*, and 1*bk*, as required.

The toner cartridges 100*y*, 100*c*, 100*m*, and 100*bk* and the process units 1*y*, 1*c*, 1*m*, and 1*bk* may be separately detachable from the image forming apparatus 1000.

Further in FIG. 1, an optical sensor unit 136 may be provided over the transfer unit 40 of the image forming apparatus 1000. Details of the optical sensor unit 136 will be described later.

Hereinafter, a drive force transmitting configuration in the image forming apparatus 1000 is described with reference to FIGS. 5 and 6. The drive force transmitting configuration may be attached to a housing structure of the image forming apparatus 1000, for example.

Figure 5:
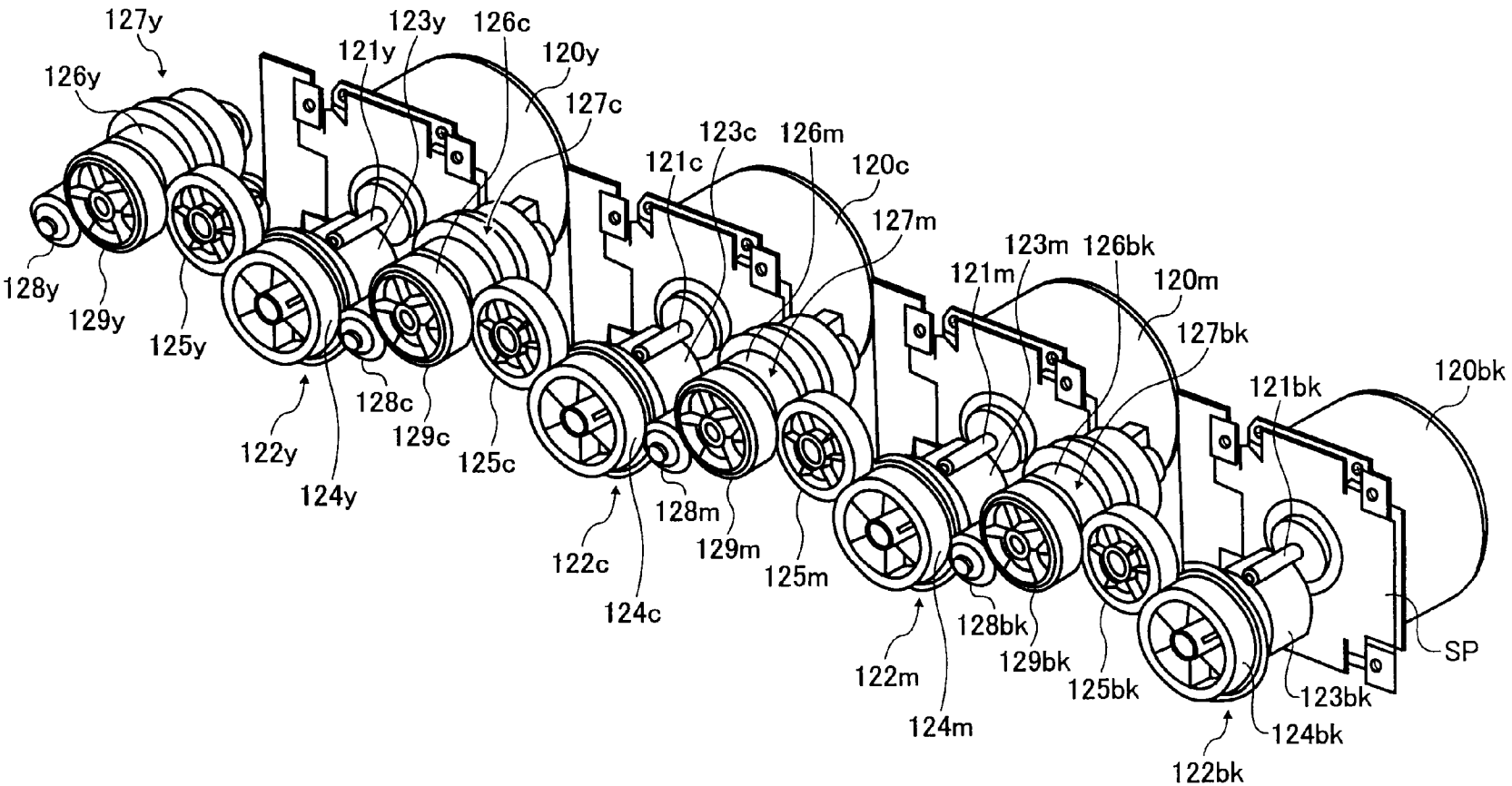
FIG. 5 is a perspective view of a drive-force transmitting configuration in the image forming apparatus of FIG. 1.

FIG. 5 is a perspective view of a drive force transmitting configuration in the image forming apparatus 1000. FIG. 6 is a top view of the drive force transmitting configuration of FIG. 5.

As shown in FIG. 5, the image forming apparatus 1000 may include a support plate SP to which process drive motors 120*y*, 120*c*, 120*m*, and 120*bk* may be attached.

The process drive motors 120*y*, 120*c*, 120*m*, and 120*bk* may drive the process unit 1*y*, 1*c*, 1*m*, and 1*bk*, respectively.

Each of the process drive motors 120*y*, 120*c*, 120*m*, and 120*bk* may include a shaft, to which drive gears 121*y*, 121*c*, 121*m*, and 121*bk* may be attached.

Under the shaft of the process drive motors 120*y*, 120*c*, 120*m*, and 120*bk*, developing gears 122*y*, 122*c*, 122*m*, and 122*bk* may be provided.

The developing gears 122*y*, 122*c*, 122*m*, and 122*bk* may drive the developing unit 7*y*, 7*m*, 7*c*, and 7*bk*.

The developing gears 122*y*, 122*c*, 122*m*, and 122*bk* may be engaged to a shaft (not shown), protruded from the support plate SP, and may rotate on the shaft.

Each of the developing gears 122*y*, 122*c*, 122*m*, and 122*bk* may include first gears 123*y*, 123*c*, 123*m*, and 123*bk*, and second gears 124*y*, 124*c*, 124*m*, and 124*bk*, respectively.

The first gear 123*y* and second gear 124*y* may have a same shaft and rotate altogether. Other first gears 123*c*, 123*m*, and 123*bk*, and second gears 124*c*, 124*m*, and 124*bk* may also have a similar configuration.

Figure 6:
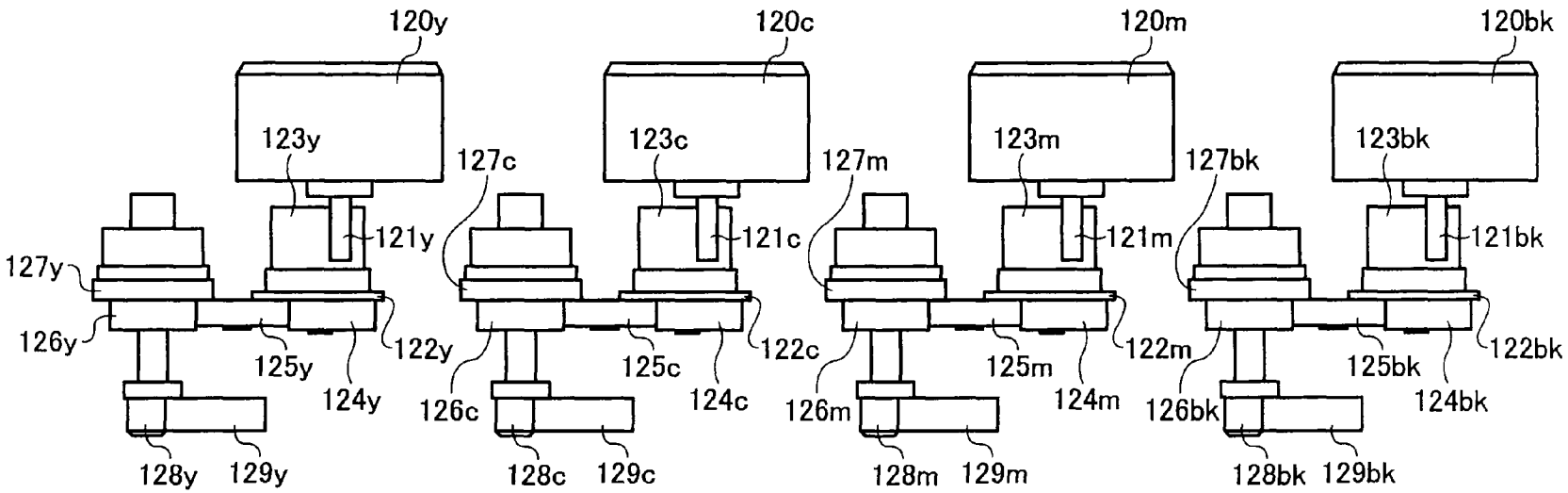
FIG. 6 is a top view of the drive-force transmitting configuration of FIG. 5.

As shown in FIGS. 5 and 6, the first gears 123*y*, 123*c*, 123*m*, and 123*bk* may be provided between the process drive motors 120*y*, 120*c*, 120*m*, and 120*bk*, and the second gears 124*y*, 124*c*, 124*m*, and 124*bk*, respectively.

The first gears 123*y*, 123*m*, 123*c*, and 123*bk* may be meshed to the drive gears 121*y*, 121*c*, 121*m*, and 121*bk* of the process drive motors 120*y*, 120*c*, 120*m*, and 120*bk*, respectively.

Accordingly, the developing gears 122*y*, 122*m*, 122*c*, and 122*bk* may be rotatable by a rotation of the process drive motors 120*y*, 120*c*, 120*m*, and 120*bk*, respectively.

The process drive motors 120*y*, 120*c*, 120*m*, and 120*bk* may include a direct current or DC brushless motor such as a direct current or DC servomotor, for example.

The drive gears 121*y*, 121*c*, 121*m*, and 121*bk*, and photoconductor gears 133*y*, 133*c*, 133*m*, and 133*bk* (see FIGS. 8 and 9) have a given speed reduction ratio such as 1:20, for example.

Figure 8:
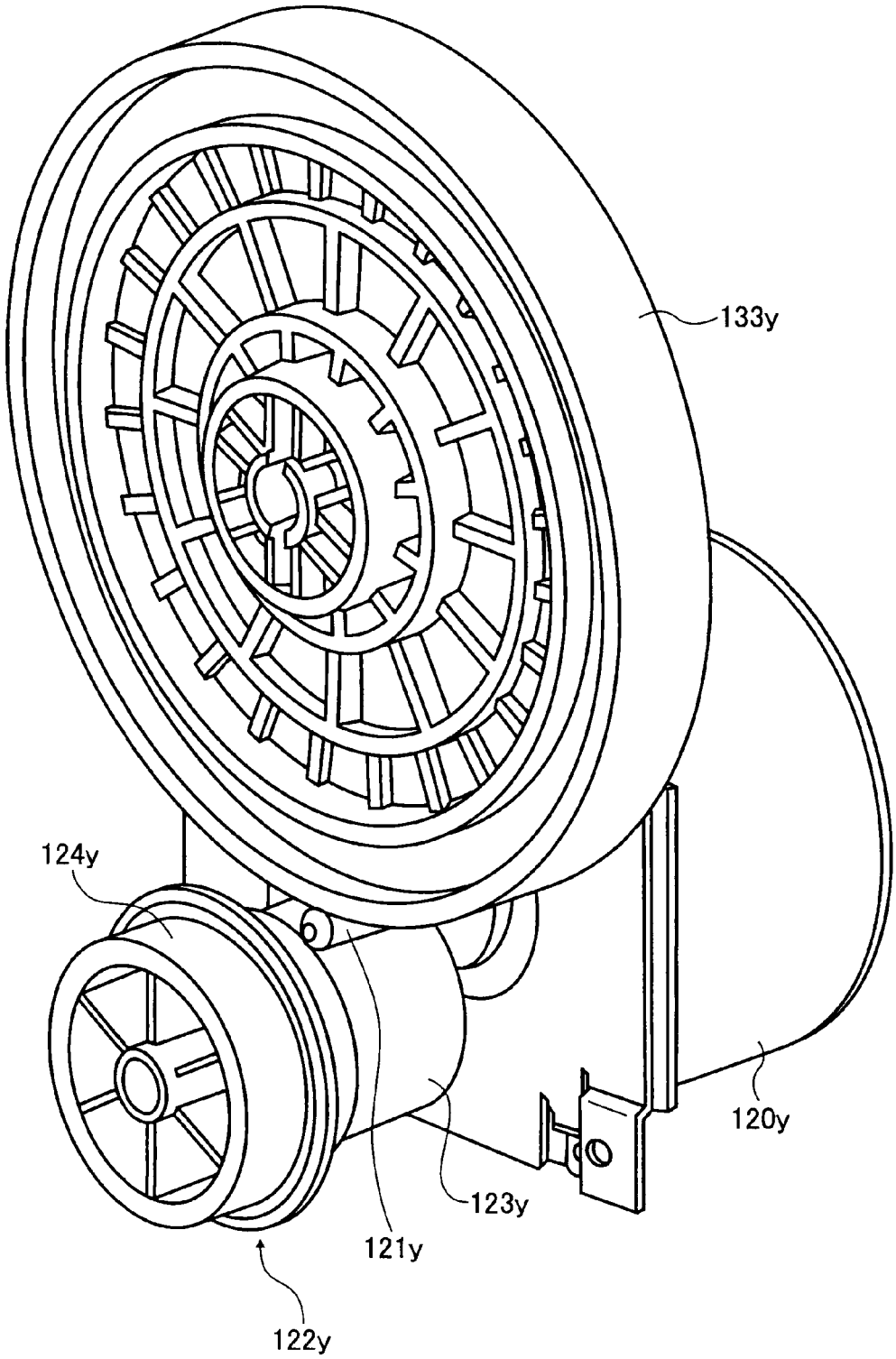
FIG. 8 is a perspective view of a photoconductor gear and its surrounding configuration.

As shown in FIG. 8, a number of speed-reduction stage from the drive gear 121 to the photoconductor gear 133 may be set to one stage in an example embodiment.

In general, the smaller the number of parts or components, the smaller the manufacturing cost of an apparatus.

Furthermore, the smaller the number of gears used for speed reduction, the smaller the effect of meshing or eccentricity error of gears, or drive-force transmitting error.

Accordingly, two gears (e.g., the drive gear 121 and the photoconductor gear 133) may be used for reducing a speed with one stage.

Such one-stage speed reduction may result into a relatively greater speed reduction ratio such as 1:20, by which a diameter of the photoconductor gear 133 may become greater than the photoconductor 3.

By using the photoconductor gear 133 having a greater diameter, a pitch deviation on a surface of the photoconductor 3 corresponding to one tooth meshing of gear may become smaller, by which an image degradation caused by uneven printing concentration in a sub-scanning direction may be reduced.

A speed reduction ratio may be set based on a relationship of a target speed of the photoconductor 3 and a physical property of the process drive motor 120. Specifically, a speed range may be determined to realize higher efficiency of motor such as reducing of motor energy loss and higher rotational precision of motor such as reducing uneven rotation of motor.

As shown in FIGS. 5 and 6, first linking gears 125*y*, 125*c*, 125*m*, and 125*bk* are provided at the left side of the developing gears 122*y*, 122*c*, 122*m*, and 122*bk*.

The first linking gears 125*y*, 125*c*, 125*m*, and 125*bk* may be rotatable on a shaft (not shown), provided on the support plate SP.

As shown in FIGS. 5 and 6, the first linking gears 125*y*, 125*c*, 125*m*, and 125*bk* may be meshed to the second gears 124*y*, 124*c*, 124*m*, and 124*bk* of the developing gears 122*y*, 122*c*, 122*m*, and 122*bk*, respectively.

Accordingly, the first linking gears 125*y*, 125*c*, 125*m*, and 125*bk* may be rotatable with a rotation of the developing gears 122*y*, 122*c*, 122*m*, and 122*bk*, respectively.

As shown in FIG. 6, the first linking gears 125*y*, 125*c*, 125*m*, and 125*bk* may be meshed to the second gears 124*y*, 124*c*, 124*m*, and 124*bk*, respectively, at an upstream side of drive force transmitting direction.

As also shown in FIG. 6, the first linking gears 125*y*, 125*c*, 125*m*, and 125*bk* may also be meshed to clutch input gears 126*y*, 126*c*, 126*m*, and 126*bk*, respectively, at a down-stream side the drive force transmitting direction.

As shown in FIGS. 5 and 6, the clutch input gears 126*y*, 126*c*, 126*m*, and 126*bk* may be supported by developing clutches 127*y*, 127*c*, 127*m*, and 127*bk*, respectively.

Each of the developing clutches 127*y*, 127*c*, 127*m*, and 127*bk* may be controlled by the controller 200 of the image forming apparatus 1000.

Specifically, the controller 200 may control power supply to the developing clutches 127*y*, 127*c*, 127*m*, and 127*bk* by conducing power ON/OFF to the developing clutches 127*y*, 127*c*, 127*m*, and 127*bk*.

Under a control by the controller 200, a clutch shaft of the developing clutches 127*y*, 127*c*, 127*m*, and 127*bk* may be engaged to the clutch input gears 126*y*, 126*c*, 126*m*, and 126*bk* to rotate with the clutch input gears 126*y*, 126*c*, 126*m*, and 126*bk*.

Or under a control by the controller 200, the clutch shaft of the developing clutches 127*y*, 127*c*, 127*m*, and 127*bk* may be disengaged from the clutch input gears 126*y*, 126*c*, 126*m*, and 126*bk* to rotate only the clutch input gears 126*y*, 126*c*, 126*m*, and 126*bk*, in which the clutch input gears 126*y*, 126*c*, 126*m*, and 126*bk* may be idling.

As shown in FIG. 6, clutch output gears 128*y*, 128*c*, 128*m*, and 128*bk* may be attached to an end of the clutch shaft of the developing clutches 127*y*, 127*c*, 127*m*, and 127*bk*, respectively.

When a power is supplied to the developing clutches 127*y*, 127*c*, 127*m*, and 127*bk*, the clutch shaft of the developing clutches 127*y*, 127*c*, 127*m*, and 127*bk* may be engaged to the clutch input gears 126*y*, 126*c*, 126*m*, and 126*bk*.

Then, a rotation of the clutch input gears 126*y*, 126*c*, 126*m*, and 126*bk* may be transmitted to the clutch shaft of the developing clutches 127*y*, 127*c*, 127*m*, and 127*bk*, by which the clutch output gears 128*y*, 128*c*, 128*m*, and 128*bk* may be rotated.

On one hand, when a power supply to the developing clutches 127*y*, 127*c*, 127*m*, and 127*bk* is stopped, the clutch shaft of the developing clutches 127*y*, 127*c*, 127*m*, and 127*bk* may be disengaged from the clutch input gears 126*y*, 126*c*, 126*m*, and 126*bk*, by which only the clutch input gears 126*y*, 126*c*, 126*m*, and 126*bk* may be idling without rotating the clutch shaft of the developing clutches 127*y*, 127*c*, 127*m*, and 127*bk*.

Accordingly, the rotation of the clutch input gears 126*y*, 126*c*, 126*m*, and 126*bk* may not be transmitted to the clutch output gears 128*y*, 128*c*, 128*m*, and 128*bk*, respectively.

Therefore, a rotation of the clutch output gears 128*y*, 128*c*, 128*m*, and 128*bk* may be stopped because the process drive motors 120*y*, 120*c*, 120*m*, and 120*bk* may be idling.

As shown in FIG. 6, second linking gears 129*y*, 129*c*, 129*m*, and 129*bk* may be meshed at the right side of the clutch output gears 128*y*, 128*c*, 128*m*, and 128*bk*, respectively.

Accordingly, the second linking gears 129*y*, 129*c*, 129*m*, and 129*bk* may be rotatable with the clutch output gears 128*y*, 128*c*, 128*m*, and 128*bk*, respectively.

The above-described drive force transmitting configuration in the image forming apparatus 1000 may transmit a drive force as below.

Specifically, a drive force may be transmitted with a sequential order beginning from the process drive motor 120, the drive gear 121, the first gear 123 and the second gear 124 of the developing gear 122, the first linking gear 125, the clutch input gear 126, the clutch output gear 128, and to the second linking gear 129.

Figure 7:
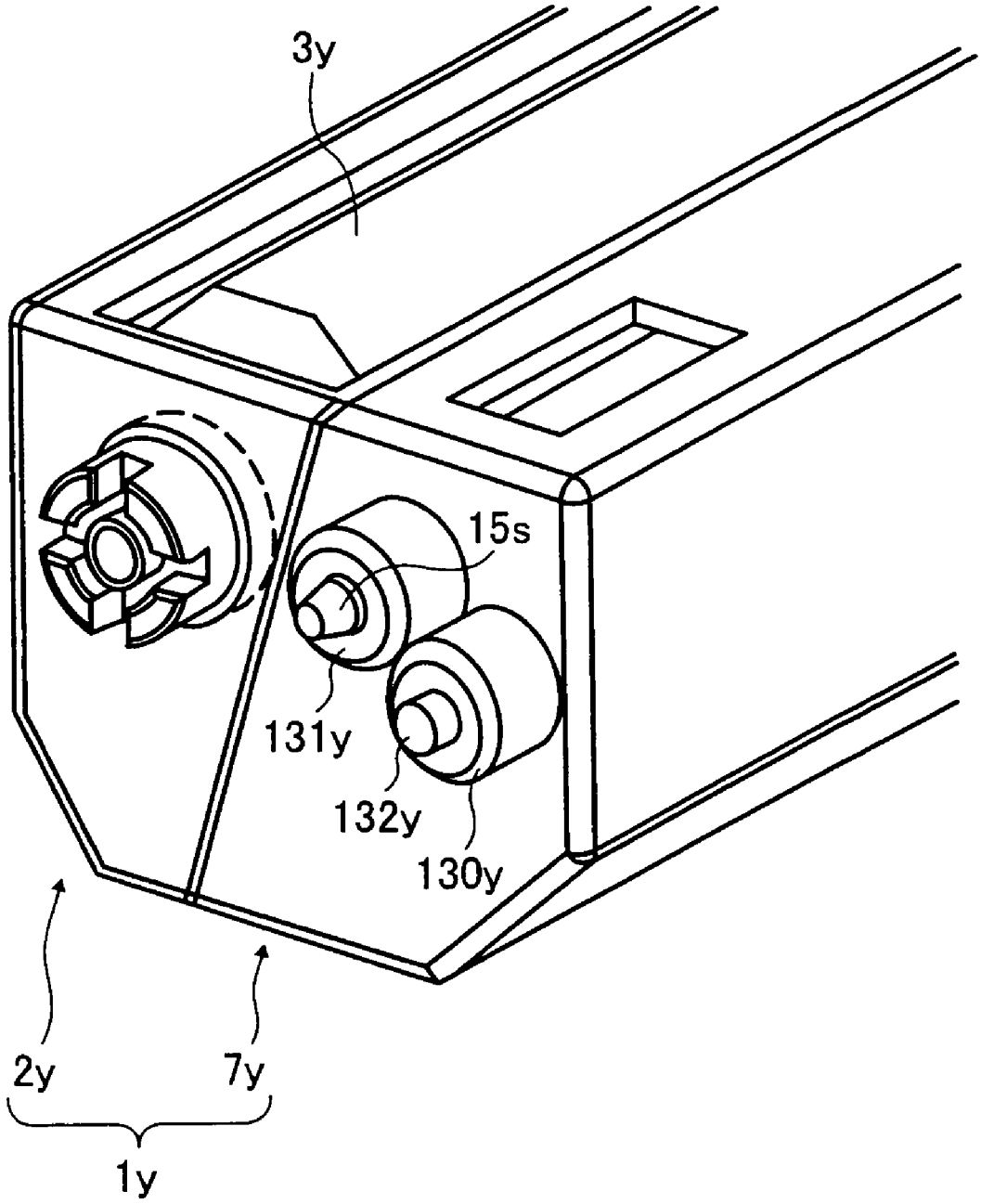
FIG. 7 is a partial perspective view of one end of the process unit of FIG. 2.

FIG. 7 is a partial perspective view of the process unit 1*y*.

The developing sleeve 15*y* in the developing unit 7*y* may have a shaft 15*s*, which protrudes from one end face of a casing of the developing unit 7*y* as shown in FIG. 7.

As shown in FIG. 7, the shaft 15*s* may be attached with a first sleeve gear 131*y*.

As also shown in FIG. 7, an attachment shaft 132*y* may be protruded from the one end face of a casing of the developing unit 7*y*.

The attachment shaft 132*y* may be attached with a third linking gear 130*y* rotatable with the attachment shaft 132*y*. The third linking gear 130*y* may mesh with the first sleeve gear 131*y* as shown in FIG. 7.

When the process unit 1*y* is set in the image forming apparatus 1000, the third linking gear 130*y* meshing with the first sleeve gear 131*y* may mesh with the second linking gear 129*y* shown in FIGS. 5 and 6.

Accordingly, a rotation of the second linking gear 129*y* may be sequentially transmitted to the third linking gear 130*y*, and then to the first sleeve gear 131*y*, by which the developing sleeve 15*y* may be rotated.

Similarly, a rotation may be transmitted to a developing sleeve of other process units 1*c*, 1*m*, and 1*bk* in a similar manner.

FIG. 7 shows one end of the process unit 1*y*. At the other end of the process unit 1*y*, the shaft 15*s* of the developing sleeve 15*y* may also be protruded from the casing, and the protruded portion of the shaft 15*s* may be attached with a second sleeve gear (not shown).

Although not shown in FIG. 7, each of the first conveying screw 8*y* and the second conveying screw 11*y* (see in FIG. 2) may have a shaft, which protrudes from the other end of the casing of the process unit 1*y*.

The protruded portion of the shafts (not shown) of the first conveying screw 8*y* and the second conveying screw 11*y* may be respectively attached with a first screw gear (not shown), and a second screw gear (not shown).

The second screw gear may mesh with the second sleeve gear (not shown), and also mesh with the first screw gear.

When the developing sleeve 15*y* is rotated by a rotation of the first sleeve gear 131*y*, the second sleeve gear at the other end of the process unit 1*y* may also be rotated.

With a rotation of the second sleeve gear, the second screw gear is rotated, and then a driving force, transmitted from the second screw gear, may rotate the second conveying screw 11*y*.

Furthermore, the first screw gear meshed to the second screw gear may transmit a driving force to the first conveying screw 8*y*, by which the first conveying screw 8*y* may rotate.

A similar configuration may be applied to other process units 1*c*, 1*m*, and 1*bk*.

As above described, each of the process units 1*y*, 1*c*, 1*m*, and 1*bk* may include a group of gears, which may be used for a developing process such as the drive gear 121, the developing gear 122, the first linking gear 125, the clutch input gear 126, the clutch output gear 128, the second linking gear 129, the third linking gear 130, the first sleeve gear 131, the second sleeve gear, the first screw gear, and the second screw gear, for example.

FIG. 8 is a perspective view of the photoconductor gear 133*y* and its surrounding configuration.

As shown in FIG. 8, the drive gear 121*y* may mesh the first gear 123*y* of the developing gear 122*y*, and the photoconductor gear 133*y*.

With such configuration, the photoconductor gear 133*y*, used as drive force transmitting member, may be rotatable by the drive force transmitting configuration of the image forming apparatus 100.

In the first exemplary embodiment, a diameter of the photoconductor gear 133*y* may be set greater than a diameter of the photoconductor 3.

When the process drive motor 120*y* rotates, a rotation of the process drive motor 120*y* may be transmitted to the photoconductor gear 133*y* via the drive gear 121 with one-stage speed reduction, by which the photoconductor 3 may rotate.

A similar configuration may be applied to other process units 1*c*, 1*m*, and 1*bk* in the image forming apparatus 1000. Therefore, four sets of gears including the drive gear 121 and the photoconductor gear 133 may be applied to each of the process units 1*y*, 1*c*, 1*m*, and 1*bk* in the image forming apparatus 1000.

A shaft of the photoconductor 3 in the process unit 1 may be connected to the photoconductor gear 133 with a coupling (not shown) attached to one end of the shaft of photoconductor 3.

The photoconductor gear 133 may be supported by an internal configuration of the image forming apparatus 1000, for example.

In the above description, one motor (e.g., the process drive motor 120) may be used for driving gears. Alternatively, a plurality of motors may be used for driving gears. For example, a motor for driving the photoconductor gear 133, and a motor for driving the drive gear 121 may be a different motor for each of the process unit 1*y*, 1*c*, 1*m*, and 1*bk*.

Hereinafter, a configuration for controlling an image forming in the image forming apparatus 1000 is described.

Figure 9:
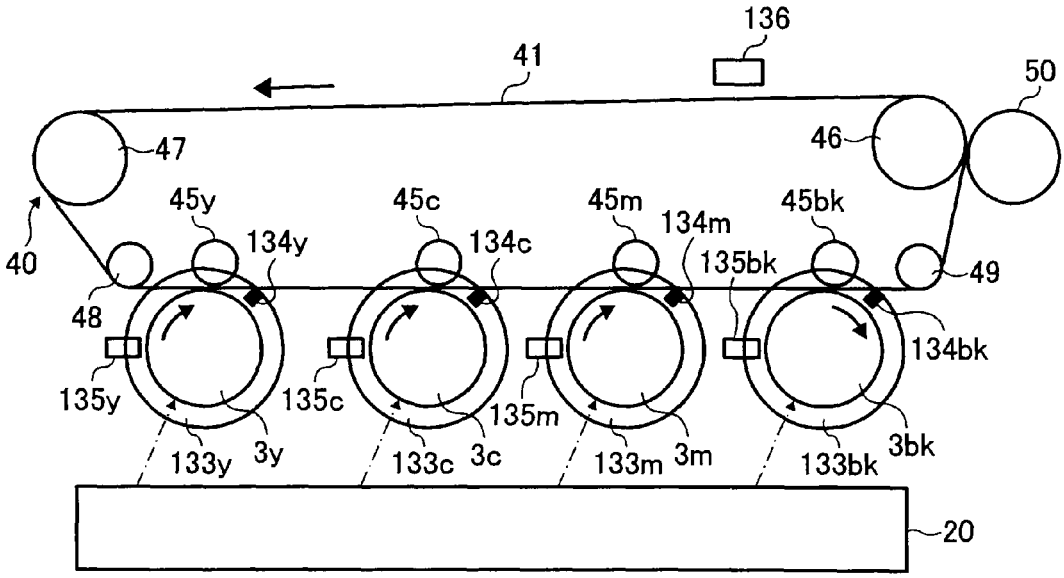
FIG. 9 is a schematic configuration of photoconductors, a transfer unit, and an optical writing unit in the image forming apparatus of FIG. 1.

FIG. 9 is a schematic configuration of the photoconductors 3*y*, 3*c*, 3*m*, and 3*bk*, the transfer unit 40, and the optical writing unit 20 in the image forming apparatus 1000.

As shown in FIG. 9, the photoconductor gears 133*y*, 133*c*, 133*m*, and 133*bk* may have respective markings 134*y*, 134*c*, 134*m*, and 134*bk* thereon at a given position.

A rotation of the photoconductor gears 133*y*, 133*c*, 133*m*, and 133*bk* may be transmitted to the respective photoconductors 3*y*, 3*c*, 3*m*, and 3*bk*.

As also shown in FIG. 9, the image forming apparatus 1000 may further include position sensors 135*y*, 135*c*, 135*m*, and 135*bk*. The position sensor 135 serving as a rotational angle detecting unit may include a photosensor, for example.

The position sensors 135*y*, 135*c*, 135*m*, and 135*bk* may detect the markings 134*y*, 134*c*, 134*m*, and 134*bk* at a given timing, respectively.

Specifically, the position sensors 135*y*, 135*c*, 135*m*, and 135*bk* may detect the markings 134*y*, 134*c*, 134*m*, and 134*bk* per one revolution of the photoconductor gears 133*y*, 133*c*, 133*m*, and 133*bk*, for example.

With such configuration, a rotational speed of the photoconductors 3*y*, 3*c*, 3*m*, and 3*bk* per one revolution may be detected.

In other words, a timing when the photoconductors 3*y*, 3*c*, 3*m*, and 3*bk* come to a given rotational angle may be detected with the position sensors 135*y*, 135*c*, 135*m*, and 135*bk* and the markings 134*y*, 134*c*, 134*m*, and 134*bk*.

As shown in FIGS. 1 and 9, the optical sensor unit 136 may be provided over the transfer unit 40, for example.

Figure 10:
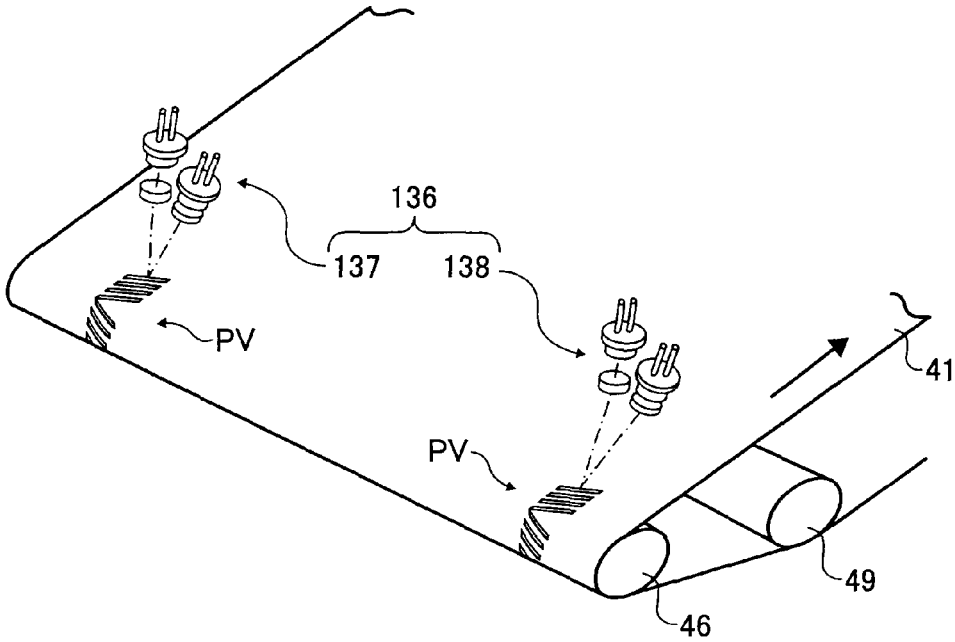
FIG. 10 is a perspective view of an intermediate transfer belt with an optical sensor unit.

As shown in FIG. 10, the optical sensor unit 136 serving as an image detecting unit may include two optical sensors 137 and 138 over the transfer unit 40, for example.

Such two optical sensors 137 and 138 may be spaced apart with each other in a width direction of the intermediate transfer belt 41, and the two optical sensors 137 and 138 may be provided over the transfer unit 40 with a given space as shown in FIG. 10.

The optical sensors 137 and 138 may include a reflection type photosensor (not shown), for example.

FIG. 10 is a perspective view of the intermediate transfer belt 41 and the optical sensor unit 136 having the optical sensors 137 and 138.

The controller 200 of the image forming apparatus 1000 may conduct a timing adjustment control at a given timing. Such timing may include when a power-supply switch (not shown) is pressed to ON, and when a given time period has lapsed, for example.

As shown in FIG. 10, the timing adjustment control may be conducted by forming a positional deviation detection image PV on a first and second lateral side of the intermediate transfer belt 41.

The positional deviation detection image PV may be used for detecting positional deviation of toner images formed on the intermediate transfer belt 41.

As shown in FIG. 10, the first and second lateral side may be opposite sides in a width direction of the intermediate transfer belt 41.

The positional deviation detection image PV for detecting positional deviation of toner images may be formed with a plurality of toner images, which will be described later.

The optical sensor unit 136, provided over the intermediate transfer belt 41, may include the optical sensors 137 and 138. The optical sensors 137 may be referred to as a first optical sensor 137, and the optical sensors 138 may be referred to as a second optical sensor 138, hereinafter.

The first optical sensor 137 may include a light source and a light receiver. A laser light beam emitted from the light source passes through a condenser lens, and reflects on a surface of the intermediate transfer belt 41. The light receiver receives the reflected laser light beam.

Based on a light intensity of the received laser light beam, the first optical sensor 137 may output a voltage signal.

When the toner images in the positional deviation detection image PV on the first lateral side of the intermediate transfer belt 41 pass through an area under the first optical sensor 137, a light intensity received by the light receiver of the first optical sensor 137 may change compared to before detecting the toner images in the positional deviation detection image PV.

Then, the first optical sensor 137 may output a voltage signal based on a light intensity received by the light receiver.

Similarly, the second optical sensor 138 may detect toner images in another positional deviation detection image PV formed on the second lateral side of the intermediate transfer belt 41.

As such, the first and second optical sensors 137 and 138 may detect toner images in the positional deviation detection image PV formed on the first and second lateral side of the intermediate transfer belt 41.

The light source may include a light emitting diode or LED, or the like, which can generate a laser light beam having a preferable level of light intensity for detecting toner image.

The light receiver may include a charge coupled device or CCD, which has a number of light receiving elements arranged in rows, for example.

With such process, toner images in a positional deviation detection image PV formed on each lateral side of the intermediate transfer belt 41 may be detected.

Based on a detection result, a position of each toner image in a main scanning direction (i.e., a scanning direction by a light beam), a position of each toner image in a sub-scanning direction (i.e., a belt traveling direction), multiplication constant error in a main scanning direction, a skew in a main scanning direction may be adjusted, for example.

Figure 11:
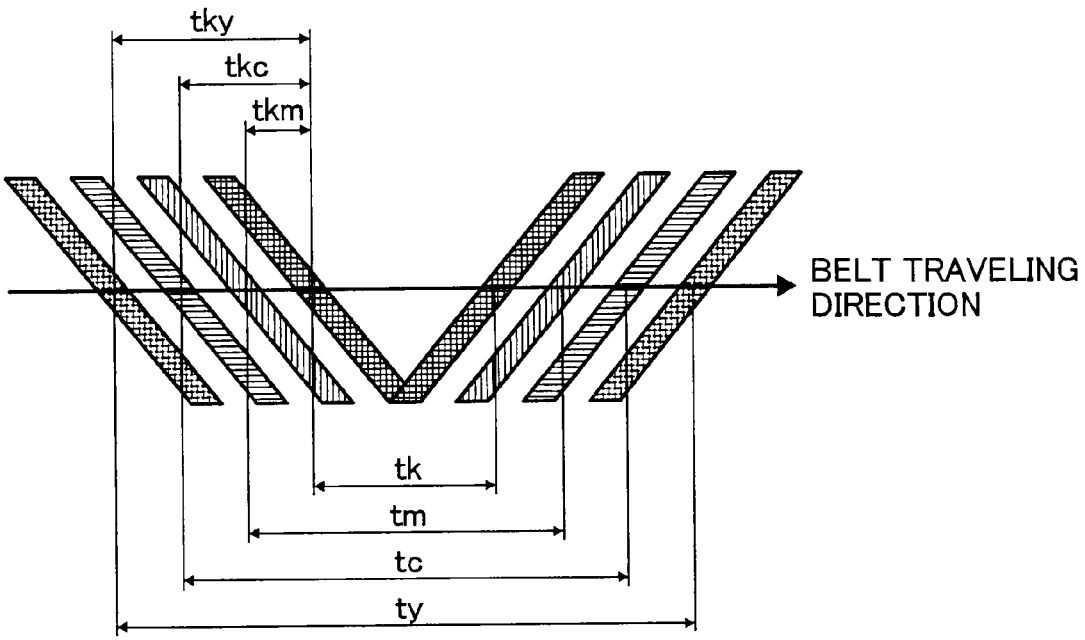
FIG. 11 is a schematic view of an image pattern for detecting positional deviation of images.

As shown in FIG. 11, the positional deviation detection image PV may include a group of line image patterns called Chevron patch, in which yellow, cyan, magenta, and black toner images may be formed on the intermediate transfer belt 41 by downwardly inclining each line image approximately 45 degrees from the main scanning direction and setting a given pitch between each of the line images in a sub-scanning direction (or a belt traveling direction).

Although the line image patterns of yellow, cyan, magenta, and black are downwardly slanted from the main scanning direction in FIG. 11, the line image patterns of yellow, cyan, magenta, and black may be formed on the intermediate transfer belt 41 without slanting from the main scanning direction. For example, line image patterns of yellow, cyan, magenta, and black, which are parallel to the main scanning direction, may be formed on the intermediate transfer belt 41, for example.

In an example embodiment, a detection time difference between a black toner image and each of other toner images (i.e., yellow, cyan, and magenta toner images) in one positional deviation detection image PV may be detected, for example.

In FIG. 11, line image patterns of yellow, cyan, magenta, and black are lined from left to right, for example.

In FIG. 11, another line image patterns of yellow, cyan, magenta, and black are lined from left to right, which may be formed on the intermediate transfer belt 41 by upwardly inclining each line image approximately 45 degrees from the main scanning direction, which means approximately 90 degrees from the previously formed line image patterns, and setting a given pitch between each of the line images in a sub-scanning direction (or a belt traveling direction).

The black toner image may be used as reference color image, and a detection time difference between the black toner image and each of yellow, cyan, and magenta toner images are referred as "tyk", "tck", and "tmk" in FIG. 11.

A difference between a measured value and a theoretical value of "tyk", "tck", and "tmk" may be compared to calculate a deviation amount of each toner image in a sub-scanning direction.

The polygon mirror 21 may have regular polygonal shape such as hexagonal shape, for example. Accordingly, the polygon mirror 21 has a plurality mirror faces having a similar shape.

If the polygon mirror 21 may have a hexagonal shape, the polygon mirror 21 has six mirror faces. If the polygon mirror 21 rotates for one revolution, an optical writing process may be conducted for six times (or six scanning lines) in a main scanning direction of an image bearing member (e.g., photoconductor), which rotates during an optical writing process.

Accordingly, a pitch of scanning line may correspond to a moving distance of an image bearing member, which rotationally moves during a time period when a laser light beam coming from one mirror face of the polygon mirror 21 scans the image bearing member.

Further, detection time differences between the respective black, magenta, cyan, and yellow toner images of the first line images and the respective black, magenta, cyan, and yellow toner images of the second line images are referred to as "tk", "tm", "tc", and "ty" in FIG. 11.

A difference between a measured value and a theoretical value of "tk", "tm", "tc", and "ty" may be compared to calculate a deviation amount of each toner image in a main scanning direction.

Skew deviation, which may cause an unpreferable slanted toner image in the main scanning direction, may be calculated based on a difference of the deviation amount of each toner image in the sub-scanning direction between both ends of the intermediate transfer belt 41.

Then, based on the calculated deviation amount of the toner images in the sub-scanning direction between both ends of the intermediate transfer belt 41, the controller 200 of the image forming apparatus 1000 may drive a lens angle adjusting mechanism (not shown) for adjusting an inclination of a toroidal lens (not shown) in the optical writing unit 20 to reduce a deviation amount of each toner image in the main scanning direction.

With such adjustment, a superimposing-deviation of toner images in the main scanning direction and sub-scanning direction may be reduced.

In the above-described timing adjustment control, an image-to-image displacement may be detected and adjusted (or controlled), wherein the image-to-image displacement may mean a situation that one color image and another color image may be incorrectly superimposed each other on the intermediate transfer belt 41. Accordingly, instead the above-described timing adjustment control, an image-to-image displacement control may be used in this disclosure, as required.

Furthermore, the controller 200 of the image forming apparatus 1000 may also conduct a speed deviation checking for each of the photoconductors 3*y*, 3*c*, 3*m*, and 3*bk*.

Specifically, the controller 200 may conduct a speed deviation checking to detect a speed deviation of each of the photoconductors 3*y*, 3*c*, 3*m*, and 3*bk* per one revolution.

In the speed deviation checking, a speed deviation checking pattern image for each of yellow, cyan, magenta, and black color may be formed on a surface of the intermediate transfer belt 41.

Hereinafter, a speed deviation checking pattern image of black color is described as a representative of yellow, cyan, magenta and black color.

Figure 12:
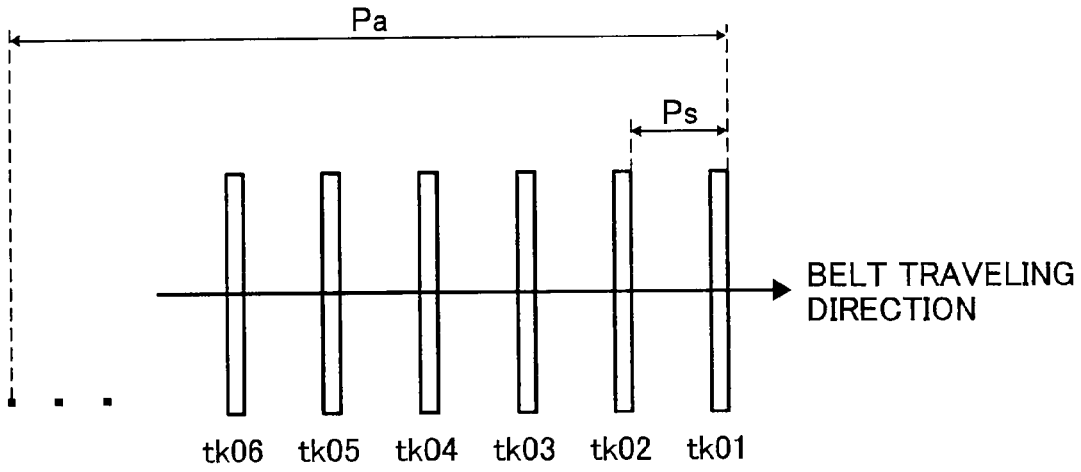
FIG. 12 is a schematic view of a speed deviation checking pattern image to be used for a phase adjustment of photoconductors.

As shown in FIG. 12, a plurality of toner images may be formed on the intermediate transfer belt 41 in a belt traveling direction (or sub-scanning direction) with a given pitch.

In FIG. 12, the plurality of toner images for black color are refereed to as "tk01, tk02, tk03, tk04, tk05, tk06, . . . " in FIG. 12, for example.

Although the toner images "tk01, tk02, tk03, tk04, tk05, and tk06, . . . " may be formed with a given theoretical pitch, an actual pitch of toner images "tk01, tk02, tk03, tk04, tk05, and tk06, . . . " may be deviated from the given theoretical pitch due to a speed deviation of the photoconductor 3*bk*.

Based on a signal, transmitted from the first and second optical sensor 137 and 138, a CPU 146 (see FIG. 13) of the controller 200 of the image forming apparatus 1000 may convert a distance value, corresponding to a pitch-deviated length, to a time difference value using an internal clock of the CPU 146.

Hereinafter, such time difference value may be referred as "time-pitch error," as required.

In the image forming apparatus 1000, a speed deviation checking may be conducted by forming a speed deviation checking pattern image of yellow color and a speed deviation checking pattern image of black color as one set.

Similarly, a speed deviation checking pattern image of cyan color and a speed deviation checking pattern image of black color may be formed as one set.

Similarly, a speed deviation checking pattern image of magenta color and a speed deviation checking pattern image of black color may be formed as one set.

Specifically, in a case in which one set of yellow and black colors is used, the speed deviation checking pattern image of yellow color may be formed on a first lateral side of the intermediate transfer belt 41, and the speed deviation checking pattern image of black color may be formed on a second lateral side of the intermediate transfer belt 41, for example.

Then, the speed deviation checking pattern image of yellow color may be detected with the first optical sensor 137, and the speed deviation checking pattern image of black color may be detected with the second optical sensor 138, wherein the first optical sensor 137 and the second optical sensor 138 may detect one set of speed deviation checking pattern images formed on the surface of the intermediate transfer belt 41 in a substantially concurrent manner, for example.

A similar process may be applied to one set of the speed-deviation images of cyan and black colors, and one set of speed-deviation images of magenta and black colors, wherein the first optical sensor 137 and the second optical sensor 138 may detect one set of speed deviation checking pattern images formed on the surface of the intermediate transfer belt 41 in a substantially concurrent manner.

In other words, the image forming apparatus 1000 may conduct three processes for the speed deviation checking: a process of forming speed deviation checking pattern images for yellow and black colors, and detecting such images with the optical sensor unit 136; a process of forming speed deviation checking pattern images for cyan and black colors, and detecting such images with the optical sensor unit 136; and a process of forming speed deviation checking pattern images for magenta and black colors, and detecting such images with the optical sensor unit 136.

The speed deviation checking process will be described later.

As previously described, the image forming apparatus 1000 having the above-described configuration may include the optical sensor unit 136 including the first and second optical sensors 137 and 138.

Then, the first and second optical sensors 137 and 138 may detect toner images or patches in the positional deviation detection images PV formed on the first and second lateral side or at least two different positions of the intermediate transfer belt 41.

Further, a combination of the process units 1*y*, 1*c*, 1*m*, and 1*bk* and the optical writing unit 20 may serve as a visible image forming unit for forming a toner image or visible image on each of respective surfaces of the process units 1*y*, 1*c*, 1*m*, and 1*bk*.

As shown in FIG. 1, the intermediate transfer belt 41 may pass through the secondary transfer nip, defined by the secondary transfer roller 50 and the intermediate transfer belt 41, before the intermediate transfer belt 41 comes to a position facing the optical sensor unit 136.

Accordingly, the above-described positional deviation detection image PV or speed deviation checking pattern image, formed on the intermediate transfer belt 41, may contact the secondary transfer roller 50 at the secondary transfer nip before the intermediate transfer belt 41 comes to the position facing the optical sensor unit 136.

If the secondary transfer roller 50 may contact the intermediate transfer belt 41 at the secondary transfer nip, the above-described positional deviation detection image PV or speed deviation checking pattern image may be transferred to a surface of the secondary transfer roller 50 from the intermediate transfer belt 41.

Accordingly, in the first exemplary embodiment of the present invention, a roller contact and separation unit (not shown) may be activated to separate the secondary transfer roller 50 from the intermediate transfer belt 41 before the above-described timing adjustment control or speed deviation checking is conducted in the image forming apparatus 1000.

With such configuration, the above-described positional deviation detection image PV or speed deviation checking pattern image may not be transferred to the secondary transfer roller 50.

Hereinafter, a circuit configuration for the controller 200 controlling the image forming apparatus 1000 is described with FIG. 13.

Figure 13:
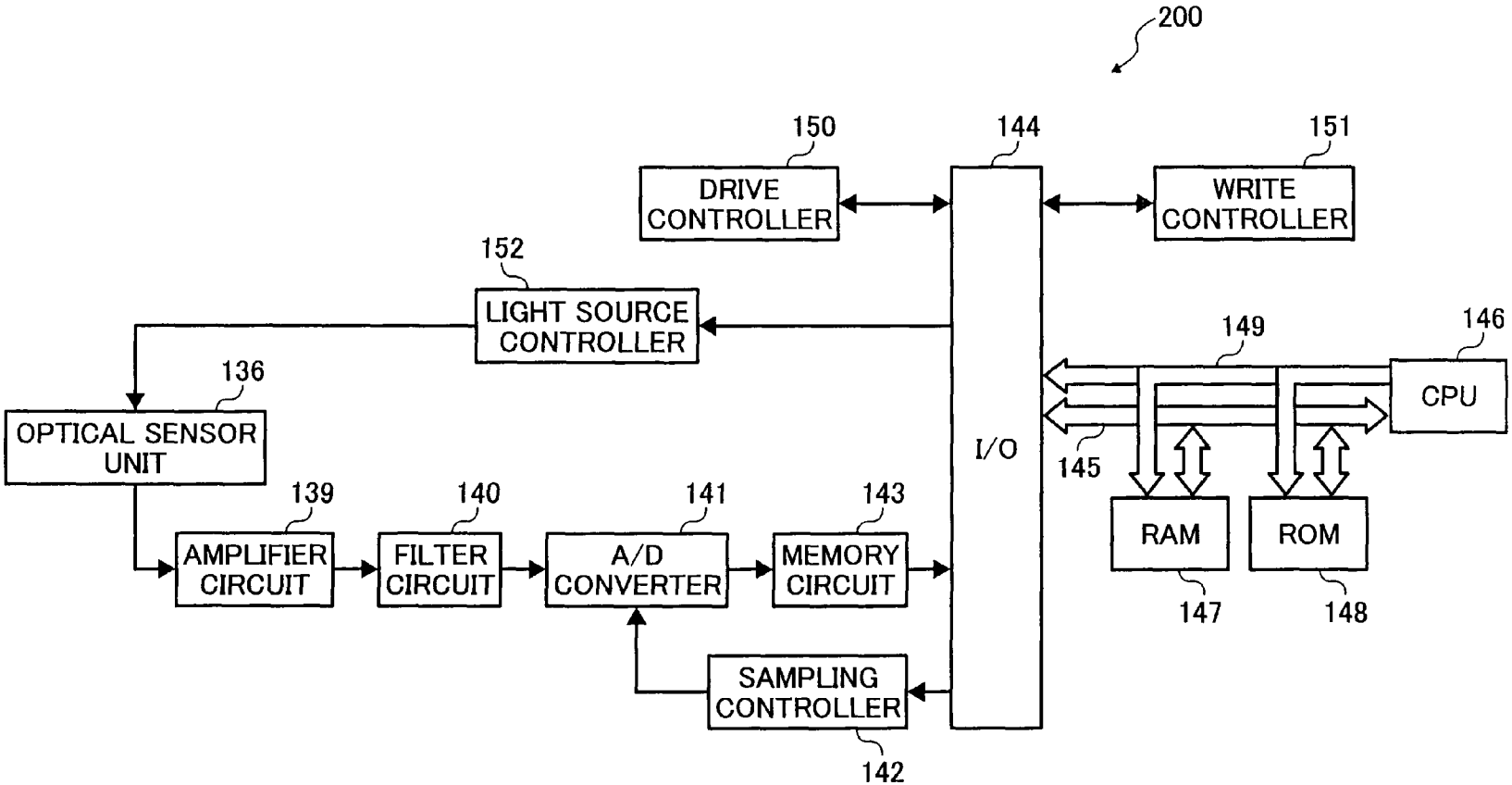
FIG. 13 is a block diagram explaining a circuit configuration of a controller of the image forming apparatus of FIG. 1.

FIG. 13 is a block diagram of a circuit configuration of the controller 200 of the image forming apparatus 1000.

The circuit configuration may include the optical sensor unit 136, an amplifier circuit 139, a filter circuit 140, an analog-to-digital converter or A/D converter 141, a sampling controller 142, a memory circuit 143, an input and output port or I/O port 144, a data bus 145, a central processing unit or CPU 146, a random access memory or RAM 147, a read only memory or ROM 148, an address bus 149, a drive controller 150, a writing controller 151, and a light source controller 152.

When the timing adjustment control or speed deviation checking is conducted, the optical sensor unit 136 may transmit a signal to the amplifier circuit 139, and the amplifier circuit 139 may amplify and transmit the signal to the filter circuit 140.

The filter circuit 140 may select a line detection signal, and transmit the selected signal to the A/D converter 141, at which analog data may be converted to digital data.

Then, the sampling controller 142 may control data sampling, and the sampled data may be stored in the memory circuit 143 by a FIFO (first-in first-out) manner.

When a detection of the positional deviation detection image PV or speed deviation checking pattern image is completed, the data stored in the memory circuit 143 may be loaded to the CPU 146 and the RAM 147 via the I/O port 144 and the data bus 145.

Then, the CPU 146 may conduct arithmetic processing to compute deviation amounts such as positional deviation of each toner image, skew deviation, phase deviation of each image bearing member (e.g., a photoconductor), for example.

The CPU 146 may also conduct arithmetic processing for computing multiplication rate for each toner image in main scanning direction and sub-scanning direction, for example.

The CPU 146 may store data to the drive controller 150 or writing controller 151 such computed data for deviation amount.

The drive controller 150 or writing controller 151 may conduct a correction operation with such data.

Such correction operation may include skew correction of each toner image, image position correction in a main scanning direction, image position correction in a sub-scanning direction, and multiplication rate correction, for example.

The drive controller 150 may control the process drive motors 120*y*, 120*c*, 120*m*, and 120*bk*, which drives the photoconductors 3*y*, 3*c*, 3*m*, and 3*bk*, respectively.

The writing controller 151 may control the optical writing unit 20.

The writing controller 151 may adjust a writing-starting position in a main scanning direction and sub-scanning direction for the photoconductors 3*y*, 3*c*, 3*m*, and 3*bk* based on data transmitted from the CPU 146.

The writing controller 151 may include a device such as clock generator using a voltage controlled oscillator or VCO to set output frequency precisely. In the image forming apparatus 1000, an output of the clock generator may be used as image clock.

The drive controller 150 may generate drive control data to control the process drive motors 120*y*, 120*c*, 120*m*, and 120*bk*, based on data transmitted from the CPU 146, to adjust a phase of each of the photoconductors 3*y*, 3*c*, 3*m*, and 3*bk* per one revolution.

In the image forming apparatus 1000, the light source controller 152 may control light intensity of the light source of the optical sensor unit 136. With such controlling, the light intensity of the light source of the optical sensor unit 136 may be maintained at a preferable level.

The ROM 148, connected to the data bus 145, may store programs such as algorithm for computing the above-described deviation amount, a program for conducting printing job, and a program for conducting a timing adjustment control, speed deviation checking, phase adjustment control, for example.

The CPU 146 may designate ROM address, RAM address, and input and output units via the address bus 149.

As shown in FIG. 12, the speed deviation checking pattern image PV may include a plurality of toner images having a same color, which are formed on the intermediate transfer belt 41 with a given pitch in a sub-scanning direction (or belt traveling direction).

A pitch Ps, shown in FIG. 12, for toner images in one speed deviation checking pattern image may preferably set to a smaller value. However, the pitch Ps may not be set too small value because of width limitation on image forming and computing-time limitation, for example.

Furthermore, a length Pa of the speed deviation checking pattern image in a sub-scanning direction (or belt moving direction) may be set to a length, which is obtained by multiplying the circumference length of the photoconductor 3 with an integer number of two or greater (e.g., two, three, four).

When setting set the length Pa, cyclical deviations not related to the photoconductor 3 may need to be considered.

Such other cyclical deviations may occur when a speed deviation checking pattern image is formed on the intermediate transfer belt 41 and when conducting the speed deviation checking.

Such other cyclical deviations may include various types of frequency components such as linear velocity deviation of the drive roller 47 per one revolution for driving the intermediate transfer belt 41, tooth pitch deviation or eccentricity of gears, which drives the intermediate transfer belt 41 or transmits a driving force to the intermediate transfer belt 41, meandering of the intermediate transfer belt 41, or thickness deviation distribution of the intermediate transfer belt 41 in a circumferential direction, for example.

In general, when the speed-deviation image is detected, a detected value may include such cyclical deviations components, which may not be related to the photoconductor 3.

Therefore, a speed deviation component of the photoconductor 3 per one revolution may need to be detected by extracting such cyclical deviation components, which may not be related to the photoconductor 3.

For example, in addition to a speed deviation component of the photoconductor 3 per one revolution, assume that a speed deviation component of the drive roller 47 per one revolution may be included in a time-pitch error when conducting a speed deviation checking pattern image.

In such a case, a speed deviation component of the drive roller 47 may need to be reduced or suppressed to set the length Pa for the speed deviation checking pattern image at a preferable level.

For example, the photoconductor 3 may have a diameter of approximately 40 mm, and the drive roller 47 may have a diameter of approximately 30 mm.

In such condition, one cycle of photoconductor 3 and one cycle of drive roller 47 may become approximately 125.7 mm, and approximately 94.2 mm, respectively. The one cycle can be calculated by a formula of "$2\pi r$," wherein "r" is a radius of circle.

A common multiple of such two cycles may be used to set a length Pa preferably for speed deviation checking.

Based on such length Pa, the pitch PS of each toner image in the speed deviation checking pattern image may be set.

With such setting, a computation of maximum amplitude or phase value of speed-deviation image of the photoconductor 3 per one revolution may be conducted with a higher precision by reducing an effect of cyclical deviation component of drive roller 47.

Such computation of maximum amplitude or phase value may be possible because a computing term of the cyclical deviation component related to the drive roller 47 may be set to substantially "zero."

Similarly, if a cyclical deviation component by thickness deviation distribution of the intermediate transfer belt 41 in a circumferential direction may be included in a time-pitch error for speed deviation checking pattern image, the length Pa of the speed deviation checking pattern image may be preferably set as below.

Specifically, the length Pa of the speed deviation checking pattern image may be obtained by (1) multiplying the circumference length of photoconductor 3 with an integer number (e.g., one, two, three times), and (2) selecting a value which is most closer to one lap of the intermediate transfer belt 41 from such integrally multiplied values.

With such setting, an effect of cyclical deviation component of intermediate transfer belt 41 may be reduced or suppressed.

Furthermore, a cyclical deviation component of a motor (not shown), which drives the drive roller 47, may have a different frequency with respect to a cyclical deviation component of photoconductor 3. If such cyclical deviation component of the drive motor (not shown) may become ten times or more of a cyclical deviation component of photoconductor 3, for example, such cyclical deviation component of the drive motor may be removed by a low-pass filter, for example.

A pulse width for each of pulse data, stored in the memory circuit 143, may vary depending on light intensity of light, which is received by the light receiver of the optical sensor unit 136.

The light intensity of light, received by the light receiver, may vary depending on a concentration level of toner image formed on the immediate transfer belt 41.

Accordingly, the pulse width for each of pulse data, stored in the memory circuit 143, may vary depending on a concentration of toner image formed on the immediate transfer belt 41.

In a case in which the timing adjustment control and the speed deviation checking are conducted, each toner image in the positional deviation detection image PV or speed deviation checking pattern image may need to be detected with higher precision.

Figure 15:
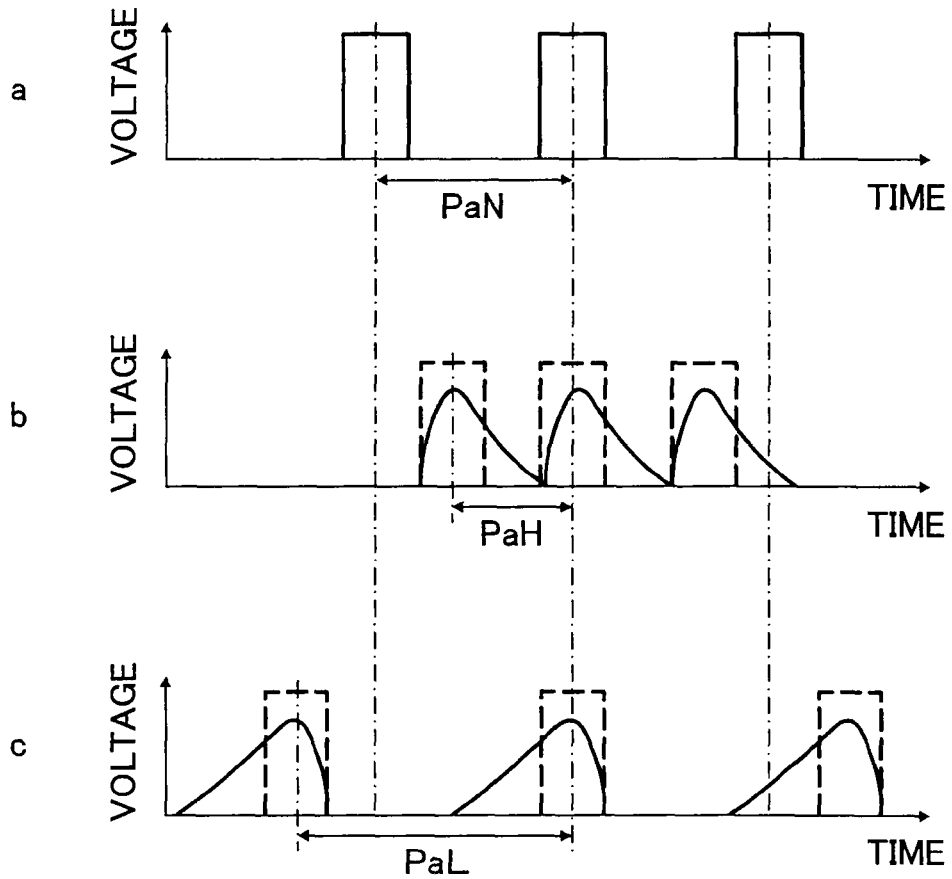
FIGS. 15(*a*), 15(*b*), and 15(*c*) are graphs showing output pulses of an optical sensor unit, which detects toner images formed on an intermediate transfer belt.

When conducting such image detection with higher precision, the CPU 146 may need to recognize a position of each of pulses even if each pulse may have a different shape in pulse width as shown in FIGS. 15(*a*) through 15(*c*).

As shown in FIGS. 15(*a*) through 15(*c*), each of pulses, having different width, may correspond to each of toner images formed on the intermediate transfer belt 41.

If the CPU 146 may recognize a pulse using a pulse width that exceeds a given threshold value, the CPU 146 may not detect toner images formed on the intermediate transfer belt 41 with higher precision in some cases shown in FIGS. 15(*b*) and 15(*c*), for example.

In view of such situation, in the image forming apparatus 1000, the CPU 146 may recognize a pulse using a pulse peak position instead of pulse width, for example.

With such configuration, the CPU 146 may more precisely recognize a pulse even if an image forming timing on the intermediate transfer belt 41 from the photoconductor 3 may be deviated from an optimal timing by a speed deviation of the photoconductor 3.

Hereinafter, the above-described pulse is described in detail with reference to FIGS. 14, 15(*a*), 15(*b*), and 15(*c*).

Figure 14:
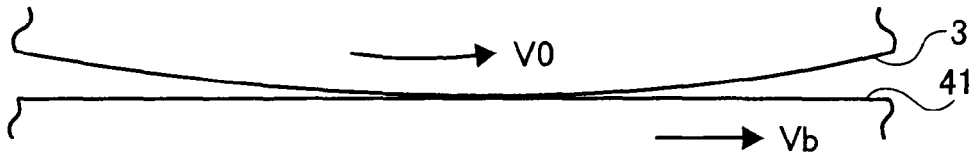
FIG. 14 is an expanded view of a primary transfer nip defined by a photoconductor and an intermediate transfer belt.

FIG. 14 is an expanded view of a primary transfer nip between the photoconductor 3 and intermediate transfer belt 41. FIGS. 15(*a*), 15(*b*), and 15(*c*) are graphs showing pulses output from the optical sensor unit 136.

FIG. 15(*a*) is a graph showing an output pulse from the optical sensor unit 136 used for detecting a toner image, which is transferred to the intermediate transfer belt 41 when the photoconductor 3 and intermediate transfer belt 41 has no substantial difference between their surface speeds.

FIG. 15(*b*) is a graph showing an output pulse from the optical sensor unit 136 used for detecting a toner image, which is transferred to the intermediate transfer belt 41 when a first surface speed V0 of the photoconductor 3 is faster than a second surface speed Vb of the intermediate transfer belt 41 at the primary transfer nip.

FIG. 15(*c*) is a graph showing an output pulse from the optical sensor unit 136 used for detecting a toner image, which is transferred to the intermediate transfer belt 41 when a first surface speed V0 of the photoconductor 3 is slower than a second surface speed Vb of the intermediate transfer belt 41 at the primary transfer nip.

At the primary transfer nip, the photoconductor 3 and intermediate transfer belt 41 may move with respective surface speeds while contacting each other at the primary transfer nip.

If the first surface speed V0 of the photoconductor 3 and the second surface speed Vb of the intermediate transfer belt 41 may set to a substantially equal speed, a pulse wave output from the optical sensor unit 136 may have a rectangular shape as shown in FIG. 15(*a*). The pulse wave may correspond to a concentration of toner image.

In this condition, each pulse may have an approximately same value as an interval PaN shown in FIG. 15(*a*).

If the first surface speed V0 of the photoconductor 3 is faster than the second surface speed Vb of the intermediate transfer belt 41, each pulse may have an interval may have an interval PaH shown in FIG. 15(*b*), which may be shorter than the interval PaN.

In such a case, a shape of each pulse may have a first mountain shape having a longer tail in a right side as shown in FIG. 15(*b*). As shown in FIG. 15(*b*), such pulse rises sharply and descents gradually.

Such pulse wave may be generated because toner images may be more condensed in one direction of belt traveling direction of the intermediate transfer belt 41 (e.g., rightward in FIG. 15(*b*)) due to a surface speed difference between the photoconductor 3 and intermediate transfer belt 41. Accordingly, toner images formed on the intermediate transfer belt 41 may have uneven concentration.

If the first surface speed V0 of the photoconductor 3 is slower than the second surface speed Vb of the intermediate transfer belt 41, each pulse may have an interval PaL shown in FIG. 15(*c*), which may be longer than the interval PaN.

In such a case, a shape of each pulse may have a second mountain shape having a longer tail in a left side as shown in FIG. 15(*c*). As shown in FIG. 15(*c*), such pulse rises gradually and descents sharply.

Such pulse wave may be generated because toner images may be more condensed in another direction of belt traveling direction of the intermediate transfer belt 41 (e.g., leftward in FIG. 15(*b*)) due to a surface speed difference between the photoconductor 3 and intermediate transfer belt 41. Accordingly, toner images formed on the intermediate transfer belt 41 may have uneven concentration.

If the CPU 146 may recognize a pulse, corresponding to a toner image formed on the intermediate transfer belt 41, when the pulse peak value exceeds a given threshold value, an unpreferable phenomenon may occur as below.

Under the conditions shown in FIGS. 15(*b*) and 15(*c*), a pulse peak may not exceed a given threshold value due to an effect of the above-described condensed toner image, and thereby the CPU 146 may not detect a toner image. Furthermore, the CPU 146 may not detect a highest concentration area of toner image.

In view of such situation, in the image forming apparatus 1000, a pulse peak itself may be used for detecting a toner image formed on the intermediate transfer belt 41, wherein the pulse peak may take any value.

Specifically, based on data stored in the memory circuit 143, the CPU 146 may recognize a pulse with a pulse peak, and store a recognized timing to the RAM 147 as timing data by assigning a data number.

With such configuration, a time-pitch error may be detected more accurately.

Next, a specific configuration of the image forming apparatus 1000 is described.

The time pitch error, stored in the RAM 147 as data, may correspond to a speed deviation of the photoconductor 3 per one revolution.

A faster speed area or lower speed area on the photoconductor 3 per one revolution may occur when an amount of eccentricity, caused by any one of the photoconductor 3, photoconductor gear 133, and a coupling connecting the photoconductor 3 and photoconductor gear 133, may become a greater value.

In other words, a faster speed or lower speed on the photoconductor 3 per one revolution may occur when the above-described eccentricity may become its upper limit or lower limit, for example.

A change of eccentricity may be expressed with a sine-wave pattern having an upper limit and a lower limit, for example.

Accordingly, a speed deviation checking of the photoconductor 3 may be analyzed by relating a pattern or amplitude of sine-wave with a timing when the position sensor 135 detects the marking 134.

At the same time, based on actually detected speed deviation patterns of the photoconductor 3 per one revolution, components of speed deviation only due to an eccentricity of the photoconductor 3, an eccentricity of the photoconductor gear 133, and an eccentricity of the coupling connecting the photoconductor 3 and photoconductor gear 133 need to be extracted.

In other words, components of speed deviation of the intermediate transfer belt 41 only due to the eccentricity of the drive roller 47 driving the intermediate transfer belt 41 need to be extracted from the entire portion of the actually detected speed deviation patterns of the photoconductor 3 per one revolution.

Figure 16:
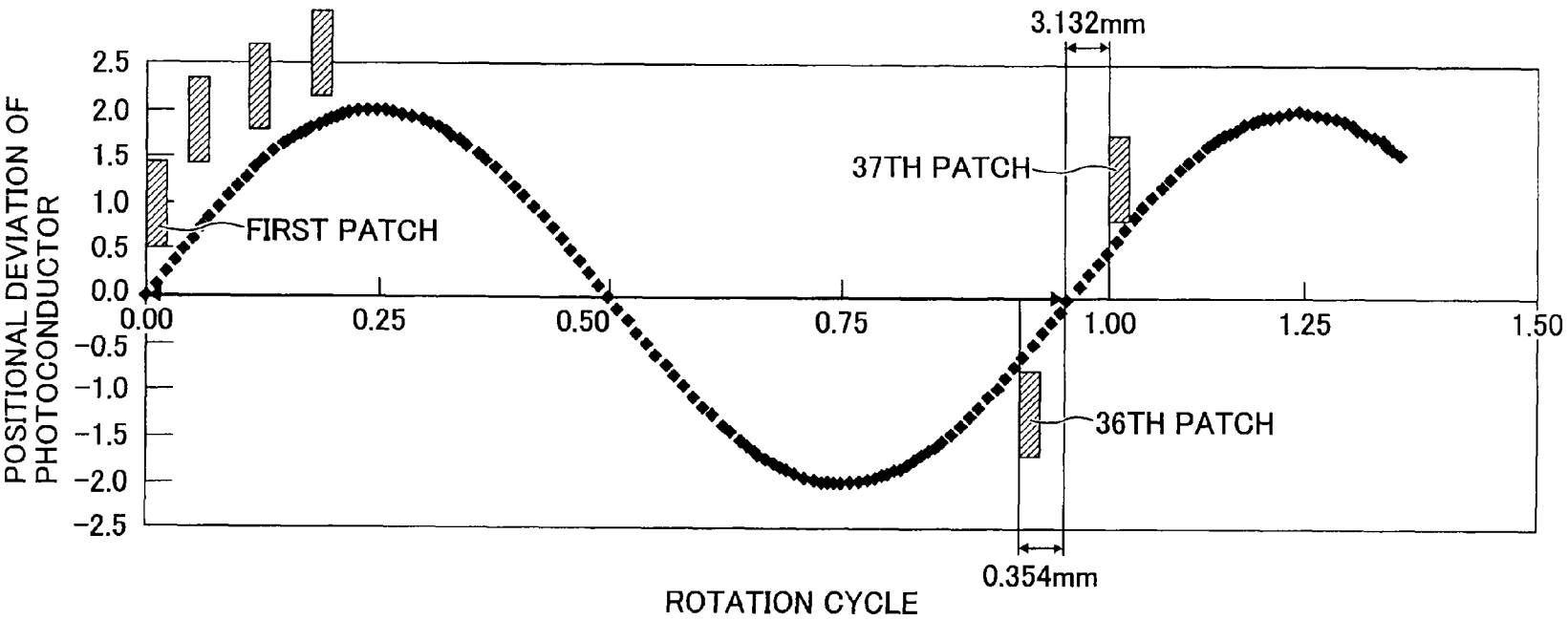
FIG. 16 is a graph showing a relationship of each patch in a speed deviation checking pattern image formed by the image forming apparatus of FIG. 1 and an amount of positional deviation of a surface of a photoconductor due to an eccentricity of the photoconductor.

FIG. 16 is a graph showing a relationship of each patch in the speed deviation checking pattern images formed on the photoconductors 3*y*, 3*c*, 3*m*, and 3*bk* of the image forming apparatus 1000 and positional deviation of the toner images formed on the surface of the photoconductor 3 having an eccentricity of the photoconductor 3. The positional deviation of the toner images may be an amount of displacement between an assumed position with a constant speed of rotation of the photoconductor 3 and an actual position with an eccentricity of the photoconductor 3.

Solid rectangular patches shown in the graph of FIG. 16 represent patches in the speed deviation checking pattern images.

A vertical axis in the graph of FIG. 16 represents amounts of the above-described positional deviation at the primary transfer nip, and a horizontal axis in the graph of FIG. 16 represents a rotational period of the photoconductor 3.

The wave shown in the graph of FIG. 16 can be represented as a speed deviation pattern of the photoconductor 3.

Each patch of the speed deviation checking pattern image is formed with a resolution of approximately 600 dpi in a circumferential direction of the photoconductor 3 at the pitch Ps of approximately 3.486 mm. The length of the pitch Ps may correspond to 83 dots (42 μm multiplied by 83 dots).

A circumferential length of the photoconductor 3 of the image forming apparatus 1000 according to the first exemplary embodiment of the present invention may be 125.850 mm, for example. That is, the photoconductor 3 may have 36 patches thereon per one revolution.

The length Pa of the speed deviation checking pattern image may be obtained by multiplying the circumference length of the photoconductor 3 with an integer number of two or greater (e.g., two, three times). Accordingly, the number of patches in the speed deviation checking pattern image may be obtained by multiplying the integer number "36" with an integer number of two or greater (e.g., two, three times).

A unit of interval for forming dots may be "μm", and significant digits of the number of dots may be rounded off to the nearest integer number.

Accordingly, a patch of the speed deviation checking pattern image formed with a resolution of approximately 600 dpi may have an interval of 42 μm for forming dots.

Further, a unit of a circumferential length of the photoconductor 3 may be "mm", and significant digits of the number of the length may be rounded off to three decimal places.

During a first revolution of the photoconductor 3, the leading edge of a first patch at a reference position in the circumferential direction of the photoconductor 3. The graph of FIG. 16 shows the time when the above-described formation occurs as a starting point or "zero" point of a rotation cycle of the photoconductor 3.

A first patch for the first revolution of the photoconductor 3 may be formed from the starting point of the rotation cycle of the photoconductor 3, and the following patches may be continuously formed at pitches of approximately 3.486 mm. Consequently, the formation of the leading edge of the 36th patch may start at a position upstream by approximately 0.354 mm from the reference position in the rotation direction of the photoconductor 3.

A first patch for the second revolution of the photoconductor 3, which is the 37th patch from the first patch for the first revolution of the photoconductor 3, may be formed at a position downstream by approximately 3.132 mm from the reference position in the rotation direction of the photoconductor 3.

Accordingly, the formation of patches may produce positional deviation on the surface of the photoconductor 3. Specifically, there may be a positional difference of approximately 3.132 mm between the first patch, a second patch, a third patch, and so on for the first revolution of the photoconductor 3 and the first patch, a second patch, a third patch, and so on for the second revolution of the photoconductor 3.

For extracting components of speed deviation of image forming units independent from the photoconductor 3, such as the components of speed deviation of the intermediate transfer belt 41 only due to the eccentricity of the drive roller 47 driving the intermediate transfer belt 41 from the entire portion of the actually detected speed deviation patterns of the photoconductor 3 per one revolution, it is generally known to use synchronous addition processing.

Synchronous addition processing, however, may be conducted based on the assumption that no relative positional deviation occurs between patches for each revolution of the photoconductor 3.

If such relative positional deviation as shown in the graph of FIG. 16 occurs, speed data calculated based on detection results of patches for the second revolution or after of the photoconductor 3 needs to be corrected according to the positional deviation. Such correction may cause arithmetic processing to become complicated.

Since corrected speed data can include estimated values, the accuracy in detection of the speed deviation pattern may be degraded.

As previously described, a speed deviation checking of the photoconductor 3 may be analyzed by relating the pattern or amplitude of sine wave with the timing when the position sensor 135 detects the marking 134.

Such analysis may be conducted by known analytic methods such as zero crossing method in which average value of all data is set to zero, and a method for analyzing amplitude and phase of deviation component from a peak value, for example.

However, detected data may be susceptible to a noise effect, by which an error may become greater in an unfavorable level when the above-described known methods are used.

Therefore, the image forming apparatus 1000 may employ a quadrature detection method for analyzing amplitude and phase of speed deviation checking pattern image.

The quadrature detection method may be a known signal analysis method, which may be used for a demodulator circuit in telecommunications sector, for example.

Figure 17:
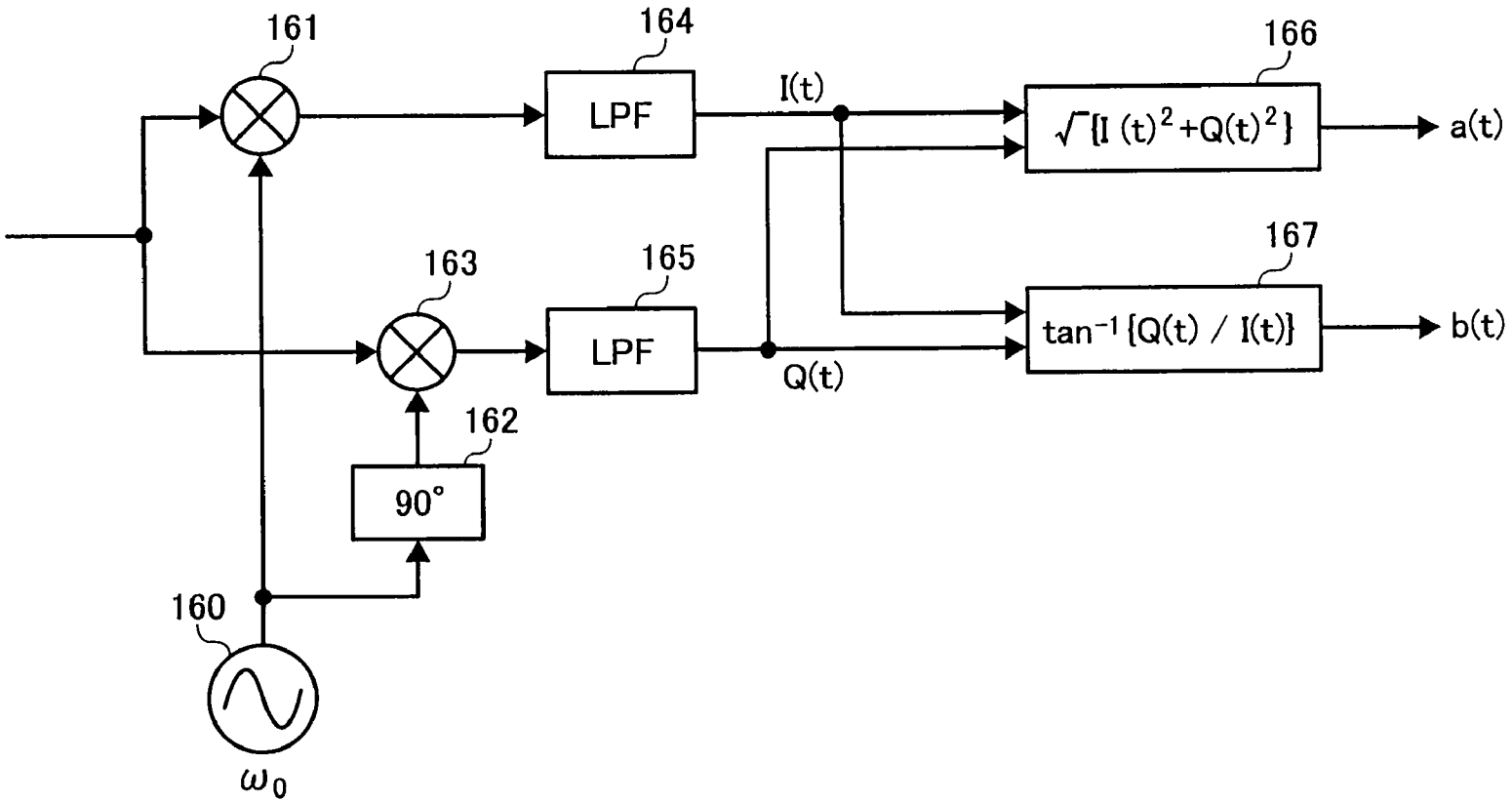
FIG. 17 is a block diagram explaining a circuit configuration for a quadrature detection method.

FIG. 17 is an example circuit configuration for conducting the quadrature detection method.

As shown FIG. 17, the circuit configuration may include an oscillator 160, a first multiplier 161, a 90-degree phase shifter 162, a second multiplier 163, a first low path filter or first LPF 164, a second low path filter or second LPF 165, an amplitude computing unit 166, and a phase computing unit 167, for example.

A signal, output from the optical sensor unit 136, may have a wave shape, and stored in the RAM 147 as data.

Such data may include a speed deviation of the photoconductor 3, and other speed deviation related to other parts such as gear.

Therefore, such data may include various types of speed deviation related to other parts, by which an overall speed deviation may increase over time.

Such various types of speed deviation related to other parts may be extracted from the data, and then the data may be converted to a deviation data.

Such various types of speed deviation related to other parts may be computed by applying least-squares method to the data, and the converted deviation data may be used as multiplication rate correction value, for example.

The converted deviation data may be processed as below.

The oscillator 160 may oscillate a frequency signal, which is to be desirably detected.

In the first example embodiment of the present invention, the oscillator 160 may oscillate such frequency signal, which is adjusted to the frequency ω0 of rotation cycle of an image bearing member (e.g., the photoconductor 3).

The oscillator 160 may oscillate the frequency signal from a phase condition, corresponding to a reference timing when forming the speed deviation checking pattern image.

When forming the speed deviation checking pattern image, the oscillator 160 may oscillate the frequency signal ω0 from a given timing (or a given phase or position) of the photoconductor 3, for example.

The oscillator 160 may output the frequency signal to the first multiplier 161, or to the second multiplier 163 via the 90-degree phase shifter 162.

The rotation cycle (or a frequency signal ω0) of the photoconductor 3 may be measured by detecting the marking 134 on the photoconductor gear 133 with the position sensor 135.

The first multiplier 161 may multiply the deviation data stored in the RAM 147 with the frequency signal, outputted from the oscillator 160.

Furthermore, the second multiplier 163 may multiply the deviation data stored in the RAM 147 with a frequency signal, outputted from the 90-degree phase shifter 162.

With such multiplication, the deviation data may be separated into two components: a phase component signal or I component signal, which may correspond to a phase of photoconductor 3; and a quadrature component signal or Q component signal, which may not correspond to the phase of photoconductor 3.

The first multiplier 161 may output the I component, and the second multiplier 163 may output the Q component.

The first LPF 164 passes through only a signal having low frequency band pass.

The image forming apparatus 1000 may employ a low pass filter (e.g., the first LPF 164), which smoothes data for the speed deviation checking pattern image having the length Pa.

With such configuration, the first LPF 164 may only pass data having a cycle, which is obtained by multiplying an rotating cycle (or oscillating cycle) ω0 with an integer number (e.g., one, two, three).

The second LPF 165 may have a similar function as in the first LPF 164.

By smoothing data having the length Pa, a cyclical rotational component of the drive roller 47 or the like may be removed from the deviation data.

The amplitude computing unit 166 may compute an amplitude a(t), which corresponds to two inputs (i.e., I component and Q component).

Furthermore, the phase computing unit 167 may compute a phase b(t), which corresponds to two inputs (i.e., I component and Q component).

Such amplitude a(t) and phase b(t) may correspond to an amplitude of one cycle of the photoconductor 3 and a phase which is angled from a given reference timing of the photoconductor 3.

Furthermore, when to detect amplitude and phase of cyclical rotational component of the drive gear 121, the above-described signal processing may be similarly conducted by setting a rotation cycle of the drive gear 121 to the oscillating cycle of ω0.

Speed data based on detection timing of each patch per one revolution of the photoconductor 3 may include values at respective points that are not synchronous to each other.

Such quadrature detection method may not correct such values to a point synchronous thereto, and can remove components of speed deviation of image forming units independent from the photoconductor 3.

As shown in FIG. 16, a speed deviation checking pattern image including a plurality of patches arranged at equal intervals or pitches for revolutions of the photoconductor 3 may be formed.

If the speed deviation checking pattern images are formed for several revolutions of the photoconductor 3, the speed deviation pattern due to an eccentricity of the photoconductor 3 can be detected in high accuracy without conducting complex arithmetic processing for synchronizing the speed data for each revolution of the photoconductor 3 even when a small amount of positional deviation occurs in the patches of the speed deviation checking pattern image for each revolution of the photoconductor 3.

Further, it may not be necessary to form a first patch of each revolution when the photoconductor 3 comes to a given rotation angle for each revolution. Accordingly, the image forming apparatus 1000 can detect a speed deviation pattern due to an eccentricity of the photoconductor 3 without including an optical sensor unit that is expensive to perform highly responsive processing for detecting a speed deviation pattern.

Furthermore, by conducting such quadrature detection method, amplitude and phase can be computed with a smaller amount of deviation data, which may be difficult by a zero crossing method or a method for detecting a pulse with a threshold value, for example.

Specifically, with respect to one rotational cycle of the photoconductor 3, a number of toner images in a speed deviation checking pattern image may be set to "4NP" (NP is a natural number) by adjusting the pitch Ps of toner images.

With such adjustment and setting, amplitude and phase can be computed with higher precision with a smaller number of toner images.

Such computation of the amplitude and phase with higher precision using a smaller number of toner images may become possible because a positional relationship of toner images having a number of 4NP may be less affected by a deviation component, and thereby an image detection sensitivity become higher.

For example, in case of four toner images, each of toner images may correspond to a zero cross position and peak position of deviation component, by which detection sensitivity may become higher. Accordingly, even if a phase of each toner image may have a deviation with each other, such toner images may have a positional relationship having higher detection sensitivity.

Based on such analysis on speed deviation checking, the CPU 146 may compute drive-control correction data for the photoconductors 3*y*, 3*c*, 3*m* and 3*bk*, and transmit the drive-control correction data to the drive controller 150.

Based on the drive-control correction data, the drive controller 150 may adjust a rotational phase of the photoconductors 3*y*, 3*c*, 3*m* and 3*bk* to reduce a phase difference among the photoconductors 3*y*, 3*c*, 3*m* and 3*bk*.

For example, if each of the photoconductors 3*y*, 3*c*, 3*m* and 3*bk* may have phases, which may be expressed by a sine-wave pattern, the drive controller 150 may adjust a rotational phase of the photoconductors 3*y*, 3*c*, 3*m* and 3*bk* so that the photoconductors 3*y*, 3*c*, 3*m* and 3*bk* may rotate from a substantially same position.

Accordingly, each phase of the photoconductors 3Y, 3C, 3M and 3K, which may be expressed by a sine-wave pattern, may be adjusted each other, by which a relative positional deviation of superimposed toner images may be reduced.

Based on the speed deviation checking, which detects a speed deviation of the photoconductors 3*y*, 3*c*, 3*m* and 3*bk*, the above-described drive control correction data corresponding to the speed deviation of the photoconductors 3*y*, 3*c*, 3*m* and 3*bk* may be computed.

Such drive-control correction data may be used for a phase adjustment control, which adjusts a phase of the photoconductors 3*y*, 3*c*, 3*m* and 3*bk*.

With such phase adjustment control of the photoconductors 3*y*, 3*c*, 3*m* and 3*bk*, dots on toner images that may not be normally transferred as shown in FIGS. 15(*b*) and 15(*c*) may be formed on the surface of intermediate transfer belt 41 in a normal manner.

In the image forming apparatus 1000, a pitch between adjacent photoconductors 3*y*, 3*c*, 3*m* and 3*bk* may be set to one times the circumference length of the photoconductor 3, by which a phase of the photoconductors 3*y*, 3*c*, 3*m* and 3*bk* may be synchronized each other.

In other words, a driving time of each of the process drive motor 120*y*, 120*c*, 120*m*, and 120*bk* may be temporarily changed so that a surface speed of each of the photoconductors 3*y*, 3*c*, 3*m* and 3*bk* photoconductor may become faster speed or lower speed at a substantially same timing.

With such configuration, toner images that may not be normally transferred as shown in FIGS. 15(*b*) and 15(*c*) may be formed on the surface of intermediate transfer belt 41 in a normal manner.

Alternatively, the image forming apparatus 1000 may include a configuration in which a pitch between adjacent photoconductors 3*y*, 3*c*, 3*m* and 3*bk* may not be obtained by multiplying a circumferential length of the photoconductor 3 with an integer number (e.g., one, two, three).

With such configuration, a phase difference on the speed deviation pattern between the adjacent photoconductors 3*y*, 3*c*, 3*m* and 3*bk* may be set each other by a given time period.

By setting such phase difference, the dots on toner images may be synchronized to each other at respective primary transfer nips.

In the image forming apparatus 1000, such phase adjustment control may be conducted when each job completes. The job may include a printing job, for example.

The phase adjustment control can be conducted before starting such job (e.g., printing job). However, such process may delay a start of first printing because a phase adjustment control is conducted between a job-activation and a printing operation for a first sheet.

Accordingly, the phase adjustment control may be preferably conducted after completing a job (e.g., printing job).

Such configuration may preferably reduce a first printing time, and may set a preferable phase relationship among the photoconductors 3*y*, 3*c*, 3*m* and 3*bk* for a next printing job.

Therefore, each of the photoconductors 3*y*, 3*c*, 3*m* and 3*bk* may be driven under a preferable phase relationship for a next job (e.g., printing job).

In general, an image forming apparatus may receive an environmental effect such as temperature change and external force, for example.

If such environmental effect may occur to the image forming apparatus, a position or shape of process units in the image forming apparatus may change.

Such external force may occur to the process units in the image forming apparatus by several reasons such as sheet jamming correction, parts replacement during maintenance, moving of image forming apparatus from one place to another place, for example.

If such external force and temperature change may occur to the process units, each color toner image may not be superimposed on an intermediate transfer belt in a precise manner.

In view of such situation, the image forming apparatus 1000 may conduct a timing adjustment control at a given timing to reduce a superimposing-deviation of each toner images.

Such given timing may include a time right after a power-switch of the image forming apparatus 1000 is set to ON condition, and a given timing which has lapsed after supplying power to the image forming apparatus 1000, for example.

In the image forming apparatus 1000, four light beams may be used for irradiating the respective photoconductors 3*y*, 3*c*, 3*m*, and 3*bk*.

Such light beams may be deflected by one common polygon mirror (i.e., polygon mirror 21), and then each of the light beams may scan each of the photoconductors 3*y*, 3*c*, 3*m*, and 3*bk* in a main scanning direction.

In such configuration, an optical-writing starting timing for each of the photoconductors 3*y*, 3*c*, 3*m*, and 3*bk* may be adjusted with a time value, obtained by multiplying a writing time of one line (i.e., one scanning line) with an integer number (e.g., one, two, three) when the timing adjustment control is conducted.

For example, assume that two photoconductors may have a superimposing-deviation in the sub-scanning direction (or surface moving direction of photoconductor 3) by more than "½ dot."

In this case, an optical-writing starting timing for one of the photoconductors may be delayed or advanced for a time value, which is obtained by multiplying a writing time for one line with integer numbers (e.g., one, two, three times).

Specifically, when a superimposing-deviation amount in a sub-scanning direction is "¾ dot," an optical-writing starting timing may be delayed or advanced for a time value, obtained by multiplying a writing time for one line with one.

When a superimposing-deviation amount in a sub-scanning direction is "7/4 dot," an optical-writing starting timing may be delayed or advanced for a time value, obtained by multiplying a writing time for one line with two.

With such controlling, a superimposing-deviation in sub-scanning direction may be suppressed ½ dot or less, for example.

However, if a superimposing-deviation amount in a sub-scanning direction is less than "½ dot," the above-explained method that delaying or advancing an optical-writing starting timing with a time value, obtained by multiplying a writing time for one line with an integer number, may unpreferably increase the superimposing-deviation amount.

Accordingly, if a superimposing-deviation amount in a sub-scanning direction is less than ½ dot, an adjustment of optical-writing starting timing may not be conducted with the above-explained method that delaying or advancing an optical-writing starting timing with a time value, obtained by multiplying a writing time for one line with an integer number.

As such, a superimposing-deviation of less than ½ dot may not be reduced by a timing adjustment control.

However, for coping with a recent market need for enhanced image quality, a superimposing-deviation of less than ½ dot may need to be reduced or suppressed.

In the image forming apparatus 1000, if a superimposing-deviation of less than ½ dot may be detected in the timing adjustment control, the CPU 146 may compute a drive-speed correction value corresponding to a deviation amount, and stores the computed drive speed correction value to the drive controller 150.

When conducting a printing job in the image forming apparatus 1000, each of the photoconductors 3*y*, 3*c*, 3*m* and 3*bk* may be driven with a drive speed based on the computed drive-speed correction value. The printing job may be instructed from an external apparatus such as personal computer, which transmits image information to the image forming apparatus 1000, for example.

With such controlling for printing job, each of the photoconductors 3*y*, 3*c*, 3*m* and 3*bk* may have a different linear velocity among the photoconductors 3*y*, 3*c*, 3*m* and 3*bk* to reduce a superimposing-deviation of less than ½ dot, as required. Accordingly, a superimposing-deviation amount may be reduced to less than ½ dot.

However, if each of the photoconductors 3*y*, 3*c*, 3*m* and 3*bk* may have a different linear velocity, a phase relationship of the photoconductors 3*y*, 3*c*, 3*m* and 3*bk* may deviate from a preferable relationship with a rotation of each of the photoconductors 3*y*, 3*c*, 3*m* and 3*bk*.

If a printing operation is conducted only one time, such phase deviation of the photoconductors 3*y*, 3*c*, 3*m*, and 3*bk* may not cause a significant trouble.

However, if a continuous printing operation is conducted to a plurality of recording sheets continuously, deviations of phase relationship of the photoconductors 3*y*, 3*c*, 3*m*, and 3*bk* may be accumulated when a number of printing sheets are increased, and a phase deviation may become unpreferably larger due to the accumulated deviations of phase relationship of the photoconductors 3*y*, 3*c*, 3*m*, and 3*bk*.

In view of such situations, the image forming apparatus 1000 may include an image quality mode and a speed, for example.

The image quality mode may set a priority on an image quality. The speed mode may set a priority on a printing speed. The image quality mode and speed mode may be selectable by operating a key on an operating panel (not shown) or by a print driver of a personal computer, for example.

If a continuous printing operation is conducted while selecting the image quality mode, the continuous printing job may be suspended at a given timing (e.g., when a given number of sheets are continuously printed) to conduct a phase adjustment control at such given timing.

As such, a superimposing-deviation of less than ½ dot may be reduced by the image forming apparatus 1000.

In a case in which a speed deviation checking is conducted, each of the photoconductors 3*y*, 3*c*, 3*m*, and 3*bk* may be driven with one similar speed (i.e., a difference between the linear velocity of the photoconductors 3*y*, 3*c*, 3*m*, and 3*bk* may be set to substantially zero).

With such configuration, a speed deviation checking pattern image for each of the photoconductors 3*y*, 3*c*, 3*m*, and 3*bk* may be detected with a similar precision level because the photoconductors 3*y*, 3*c*, 3*m*, and 3*bk* may not have a different linear velocity.

If the photoconductors 3*y*, 3*c*, 3*m*, and 3*bk* may have different linear velocity each other, one cycle rotation for each of the photoconductors 3*y*, 3*c*, 3*m*, and 3*bk* may deviate each other. If such cycle for each of the photoconductors 3*y*, 3*c*, 3*m*, and 3*bk* may become an undesired value, a computation result by quadrature detection method may have an error.

In general, a speed-deviation of photoconductor 3 per one revolution may less likely receive an effect of temperature change and external force.

Therefore, the speed deviation checking for photoconductor 3 may be conducted with less frequency (e.g. longer time interval between adjacent checking operations) compared to the timing adjustment control.

However, if the process unit 1 is replaced from the image forming apparatus 1000, a speed-deviation of the photoconductor 3 may change relatively greater.

In such a situation of the image forming apparatus 1000, a speed deviation checking may be conducted when any one of the process units 1*y*, 1*c*, 1*m*, and 1*bk* may be replaced, for example.

For example, a replacement detector (not shown) may be provided to the each of the process units 1*y*, 1*c*, 1*m*, and 1*bk* to detect a replacement of the process unit 1.

A unit sensor (not shown) may transmit a signal to the replacement detector that the process unit 1 is replaced with a new one by changing the signal from "OFF" to "ON" when the process unit 1 is replaced.

The replacement detector may judge that the process unit 1 is replaced when the replacement detector receives such signal from the unit sensor.

Furthermore, the process unit 1 may include an electric circuit board having an IC (integrated circuit), which may store a unit ID (identification) number. The electric circuit board may be coupled to the CPU 146.

When the process unit 1 is replaced with new one, a unit ID number may also be changed because each process unit 1 may have unique unit ID number. The replacement detector 80 may detect a change of unit ID number to recognize a replacement of the process unit 1.

In the image forming apparatus 1000, a speed deviation checking and phase adjustment control may be conducted with a timing adjustment control as one set.

Specifically, when a replacement of process unit 1 is detected, a timing adjustment control may be conducted, and then a speed deviation checking and a phase adjustment control may be conducted. Then, another timing adjustment control may be conducted again.

During such control process, a printing job may not be conducted.

Hereinafter, such a control process to be conducted after replacing the process unit 1 may be referred to after-replacement control, as required.

In the image forming apparatus 1000, the after-replacement control may be conducted as below.

At first, a first timing adjustment control may be conducted. Then, each of the photoconductors 3*y*, 3*c*, 3*m*, and 3*bk* may be stopped before conducting a speed deviation checking.

In this case, each of the photoconductors 3*y*, 3*c*, 3*m*, and 3*bk* may not be stopped by a phase relationship of the photoconductors 3*y*, 3*c*, 3*m*, and 3*bk* that the photoconductors 3*y*, 3*c*, 3*m*, and 3*bk* have before the replacement of the process unit 1.

Instead, each of the photoconductors 3*y*, 3*c*, 3*m*, and 3*bk* may be stopped at a reference phase position, which is set in the image forming apparatus 1000.

Specifically, each of process drive motor 120*y*, 120*c*, 120*m*, and 120*bk* may be stopped at a reference timing which comes in at a given time period after the photosensor 135 detects the marking 134 on the photoconductor gear 133.

For example, the photoconductor 3K may be used as a reference photoconductor, and a reference timing may be determined with the photoconductor 3*bk*.

With such controlling, each of the photoconductors 3*y*, 3*c*, 3*m*, and 3*bk* may stop under a condition that the marking 134 on each photoconductor gear 133 may be positioned to a similar rotational angle position.

With such stopping of the photoconductors 3*y*, 3*c*, 3*m*, and 3*bk*, a speed deviation checking may be conducted by rotating each of the photoconductors 3*y*, 3*c*, 3*m*, and 3*bk* from a similar rotational angle position.

Figure 18:
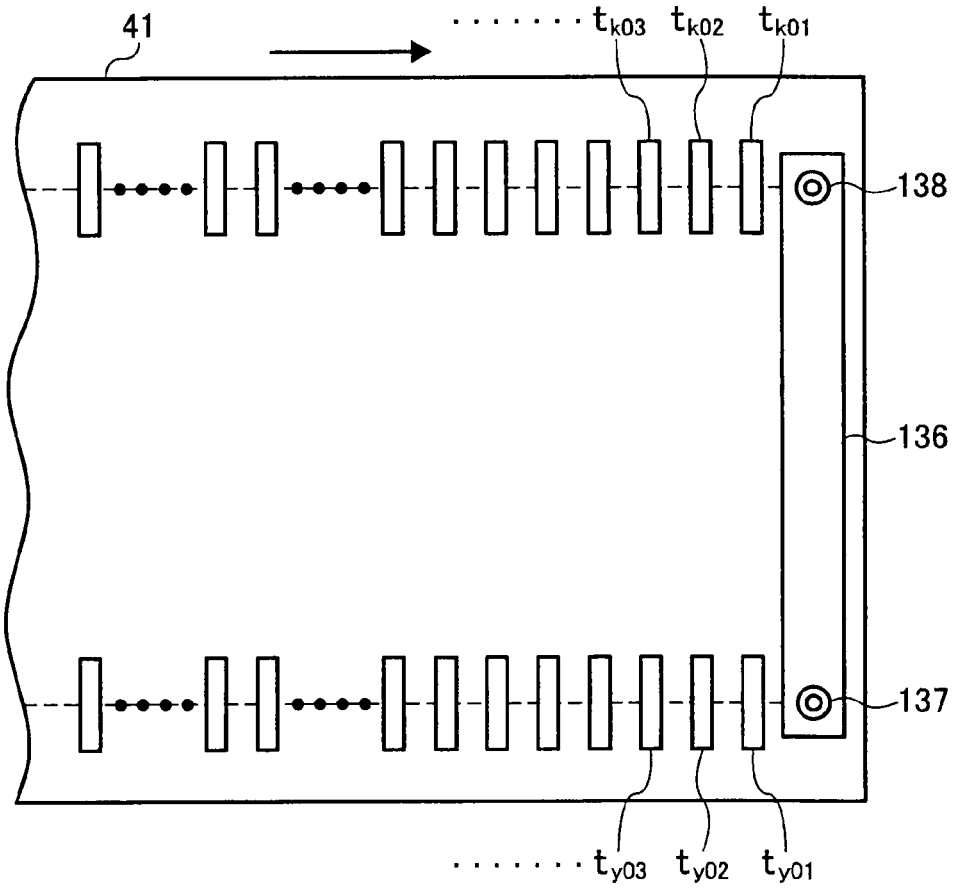
FIG. 18 is a schematic plan view showing a speed deviation checking pattern image of black and a speed deviation checking pattern image of yellow formed on the intermediate transfer belt.

FIG. 18 is a schematic plan view showing a portion of a speed deviation checking pattern image of black (i.e., reference image) and a portion of a speed deviation checking pattern image of yellow, both of which may be formed by the image forming apparatus 1000, with a portion of the intermediate transfer belt 41.

In the image forming apparatus 1000, the photoconductor 3*bk* for forming black toner image may serve as a reference photoconductor among the four photoconductors 3*y*, 3*c*, 3*m*, and 3*bk*.

Furthermore, in speed deviation checking, speed deviation checking pattern images of yellow, cyan, and magenta may be formed along with a speed deviation checking pattern image of black (i.e., reference image) to detect the speed deviation checking pattern images of yellow, cyan, and magenta and the speed deviation checking pattern image of black at the same time.

For example, the speed deviation checking pattern image of yellow may include a plurality of yellow patches "ty01, ty02, ty03, . . . " and the speed deviation checking pattern image of black may include a plurality of black patches "tbk01, tbk02, tbk03, . . . ."

As shown in FIG. 18, the yellow patches "ty01, ty02, ty03, . . . " of the speed deviation checking pattern image of yellow may be formed on the first lateral side of the intermediate transfer belt 41 to be detected by the first optical sensor 137.

At the same time, the black patches "tbk01, tbk02, tbk03, . . . " of the speed deviation checking pattern image of black may be formed on the second lateral side of the intermediate transfer belt 41 to be detected by the second optical sensor 138.

Similarly, cyan patches of the speed deviation checking pattern image of cyan may be formed on the first lateral side of the intermediate transfer belt 41 to be detected by the first optical sensor 137 while the black patches "tbk01, tbk02, tbk03, . . . " of the speed deviation checking pattern image of black are formed on the second lateral side of the intermediate transfer belt 41 to be detected by the second optical sensor 138.

Similarly, magenta patches of the speed deviation checking pattern image of magenta may be formed on the first lateral side of the intermediate transfer belt 41 to be detected by the first optical sensor 137 while the black patches "tbk01, tbk02, tbk03, . . . " of the speed deviation checking pattern image of black are formed on the second lateral side of the intermediate transfer belt 41 to be detected by the second optical sensor 138.

The photoconductor 3*bk* may be used as a reference image bearing member for adjusting speed deviation of the photoconductors 3*y*, 3*c*, 3*m*, and 3*bk*.

In such configuration, a phase of the photoconductors 3*y*, 3*c*, and 3*m* may be matched to a phase of the photoconductor 3*bk*. With such configuration, a speed deviation component of the intermediate transfer belt 41 may less likely to affect the phase of the photoconductors 3*y*, 3*c*, 3*m*, and 3*bk*.

Specifically, a speed deviation may include a speed deviation of the intermediate transfer belt 41 at a position facing the optical sensor unit 136 in addition to the speed deviation of the photoconductors 3*y*, 3*c*, 3*m*, and 3*bk*.

Accordingly, even if speed deviation checking pattern images are formed on the intermediate transfer belt 41 with an equal pitch each other, a time pitch error may occur to the speed deviation checking pattern images if a moving speed of the intermediate transfer belt 41 may change.

To reduce such time-pitch error, a speed deviation checking pattern image of black (i.e., reference image) and a speed deviation checking pattern image of yellow, magenta, and cyan may need to be detected concurrently.

Accordingly, in the image forming apparatus 1000, a speed deviation checking pattern image of one of yellow, cyan, or magenta, and a speed deviation checking pattern image of black may be formed on the intermediate transfer belt 41 as one set.

In the image forming apparatus 1000, the speed deviation checking pattern image of black may be formed on the first lateral side of the intermediate transfer belt 41, and the speed deviation checking pattern image of one of yellow, cyan, or magenta may be formed on the second lateral side of the intermediate transfer belt 41.

The speed deviation checking pattern image of black may be formed at a timing that the marking 134*bk* is detected by the photosensor 135*bk*.

Furthermore, the speed deviation checking pattern images of yellow, cyan, and magenta may be formed from a timing that the photosensor 135*bk* detects the marking 134*bk* instead of a timing that the photosensor 135*y*, 135*c*, and 135*m* detect the markings 134*y*, 134*c*, and 134*m*, respectively.

With such controlling, a front edge of the speed deviation checking pattern images of yellow, cyan, and magenta and a front edge of the speed deviation checking pattern image of black may be aligned in a width direction of the intermediate transfer belt 41.

Thus, a phase difference between the image of black and the image of other one of yellow, cyan, or magenta may be detected.

Accordingly, a phase alignment of speed deviation checking pattern images of black and one of yellow, cyan, magenta may be conducted by shifting a position of marking 134K with respect to the markings 134*y*, 134*c*, and 134*m* based on the phase difference obtained from the above-described process.

Then, a speed deviation checking may be conducted without using a detection timing that the position sensors 135*y*, 135*c*, and 135*m* detects the markings 134*y*, 134*c*, and 134*m*.

Specifically, a phase deviation between the speed deviation checking pattern image of one of yellow, cyan, and magenta and speed deviation checking pattern image of black may be detected.

However, if the process unit 1 is replaced with a new one, a superimposing deviation of toner images may become larger than before replacing the process unit 1. In such a case, a detection result of the phase deviation may shift with such superimposing deviation.

Therefore, in the image forming apparatus 1000, a timing adjustment control may be conducted before a speed deviation checking to reduce a superimposing deviation of toner images.

Alternatively, one of a speed deviation checking pattern image of one of yellow, cyan, and magenta and a speed deviation checking pattern image of black may be formed on a center portion of the intermediate transfer belt 41 instead of forming one of the above-described speed deviation checking pattern images on the first or second lateral side of the intermediate transfer belt 41.

With such configuration, an optical sensor may be arranged at an optimal center position so as to detect the speed deviation checking pattern image formed on the center portion of the intermediate transfer belt 41.

Such configuration having the speed deviation checking pattern image on the center portion of the intermediate transfer belt 41, however, may not be a preferable configuration because of the following factor.

Compared with the first and second lateral side, the center portion in the width direction of the intermediate transfer belt 41 may be relatively suffered by rising of a surface of a tension roller (i.e., the tension roller 49) due to deflection of the tension roller 49.

Such rising of a surface of the tension roller 49 may easily increase deterioration of accuracy in detection of the speed deviation checking pattern image.

Accordingly, the above-described configuration may not be preferable.

As a further alternative, the optical sensor unit 136 may include four or more optical sensors and the speed deviation checking pattern images of yellow, cyan, magenta, and black may be simultaneously formed in a width direction of the intermediate transfer belt 41.

With such configuration, the speed deviation checking pattern images of yellow, cyan, magenta, and black of the photoconductors 3*y*, 3*c*, 3*m*, and 3*bk* can be detected at the same time.

Such configuration can detect the speed deviation checking pattern images of yellow, cyan, magenta, and black for a relatively short period.

At the same time, however, an increase of the number of optical sensors may cause a cost increase.

Hereinafter, a process for the above-described after-replacement control is explained with reference to FIG. 19.

Figure 19A:
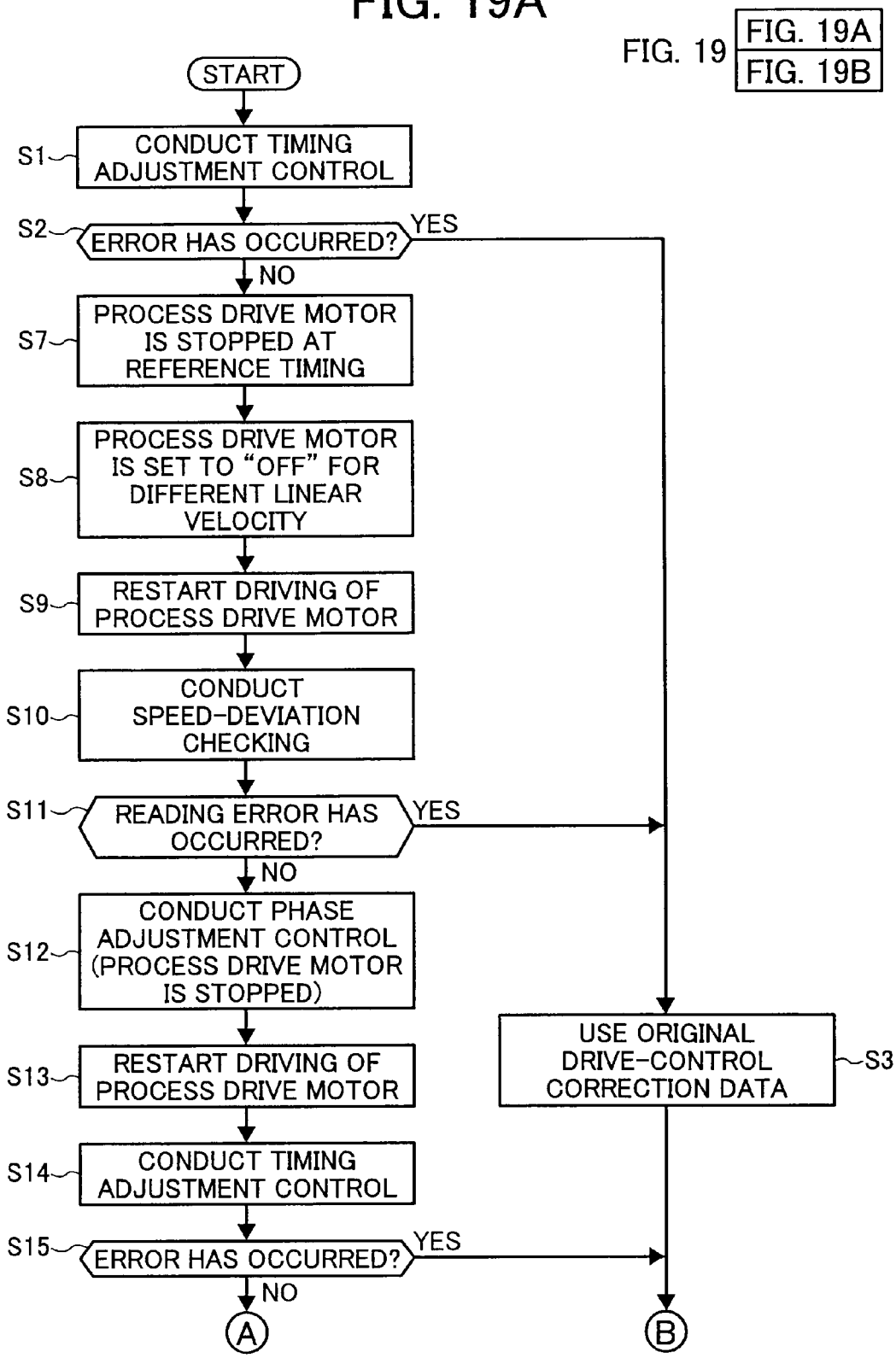
FIGS. 19A and 19B show a flow chart for explaining a process to be conducted after detecting a replacement of a process unit and before conducting a printing job.
Figure 19B:
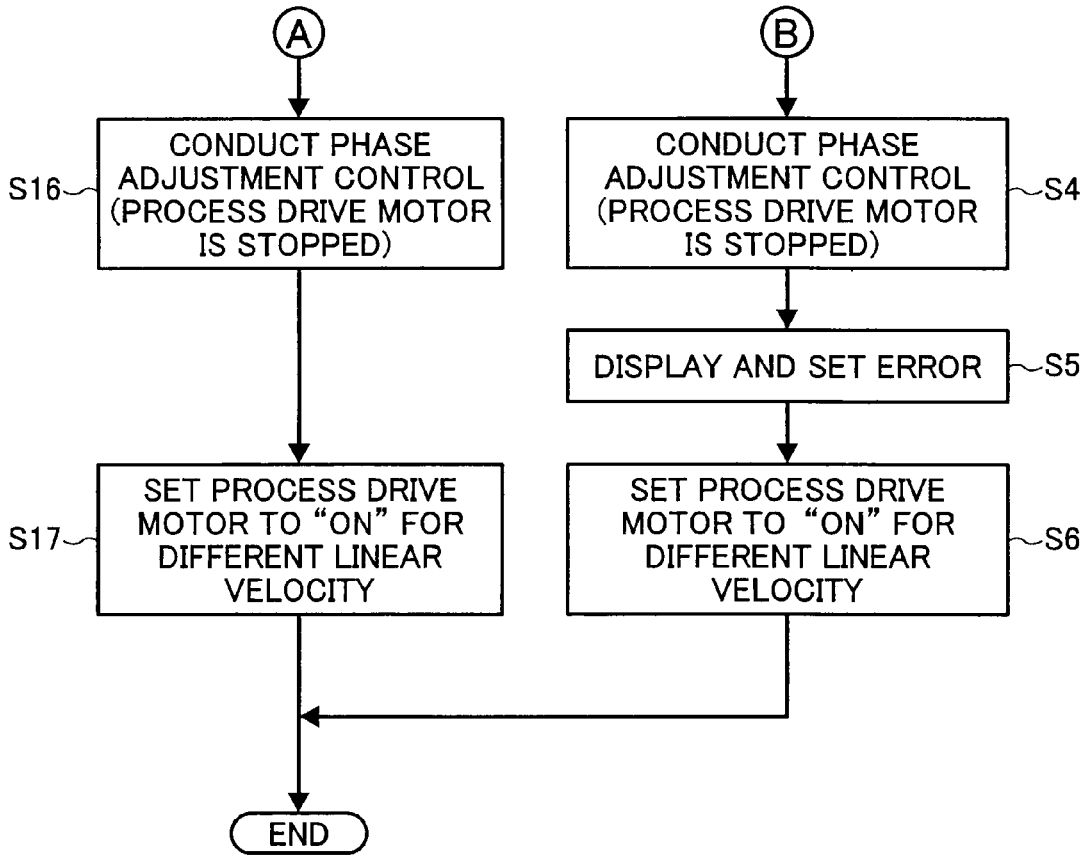

FIG. 19 is a flow chart for explaining a control process to be conducted after detecting a replacement of the process unit 1 and before conducting a printing job.

A replacement of the process units 1 may be detected when one process units 1 is replaced from the image forming apparatus 1000.

At step S1, the CPU 146 conducts a timing adjustment control.

At step S2, the CPU 146 checks whether an error has occurred.

If the CPU 146 confirms the error has occurred at step S2, the process goes to step S3.

Such error may include that image reading is impossible, abnormal value is read, and correction is failed, for example.

At step S3, the CPU 146 uses an original drive-control correction data for adjusting a phase of each of the photoconductors 3*y*, 3*c*, 3*m*, and 3*bk*. In this case, the original drive-control correction data may mean data that the process unit 1 has before the replacement.

Then, the CPU 146 conducts a phase adjustment control at step S4.

In the phase adjustment control, each of the photoconductors 3*y*, 3*c*, 3*m*, and 3*bk* is stopped while synchronizing phases of the photoconductors 3*y*, 3*c*, 3*m*, and 3*bk* based on the original drive-control correction data, and the CPU 146 displays an error on an operating panel (not shown) at step S5.

At step S6, the CPU 146 sets different linear velocities to each of the process drive motors 120*y*, 120*c*, 120*m*, and 120*bk* (i.e., setting of different linear velocities is set to ON). Then, the control process ends.

Because the CPU 146 sets the different linear velocities to each of the process drive motors 120*y*, 120*c*, 120*m*, and 120*bk*, each of the photoconductors 3*y*, 3*c*, 3*m*, and 3*bk* is set with different linear velocities to reduce a superimposing-deviation of less than ½ dot for a printing job. The printing job will be conducted after completing the process shown in FIG. 19.

If the CPU 146 confirms the error has not occurred at step S2, the process goes to step S7.

At step S7, the CPU 146 stops each of the process drive motors 120*y*, 120*c*, 120*m*, and 120*bk* at a given reference timing, in which each of the photoconductor gears 133*y*, 133*c*, 133*m*, and 133*bk* may be stopped while positioning the markings 134*y*, 134*c*, 134*m*, and 134*bk* on the respective photoconductor gears 133*y*, 133*c*, 133*m*, and 133*bk* at a similar same rotational angle.

Then, at step S8, the CPU 146 cancels the setting of the different linear velocities to each of the process drive motors 120*y*, 120*c*, 120*m*, and 120*bk* (i.e., setting of different linear velocities is set to OFF).

At step S9, the CPU 146 restarts a driving of process drive motors 120*y*, 120*c*, 120*m*, and 120*bk*.

At step S10, the CPU 146 conducts a speed deviation checking.

Because the CPU 146 cancels the setting of the different linear velocities to each of the process drive motors 120*y*, 120*c*, 120*m*, and 120*bk* at step S8, each of the photoconductors 3*y*, 3*c*, 3*m*, and 3*bk* is driven with a similar speed during the speed deviation checking.

Accordingly, a speed deviation checking of the photoconductors 3*y*, 3*c*, 3*m*, and 3*bk* may be conducted at a higher precision because each of the photoconductors 3*y*, 3*c*, 3*m*, and 3*bk* is driven with the similar speed during the speed deviation checking.

When the speed deviation checking has completed, the CPU 146 checks whether a reading error has occurred at step S11.

For example, the reading error may include that a number of read image patters are not matched to a number of actually formed latent image, wherein such phenomenon may be caused when a scratch on the belt is read, or when a toner image formed on the belt has a very faint concentration which may be too faint for reading.

If the CPU 146 confirms that the reading error has occurred at step S11, the above-explained steps S2 to S6 are conducted, and the control process ends.

If the CPU 146 confirms that the reading error has not occurred at step S11, the process goes to step S12.

At step S12, the CPU 146 conducts a phase adjustment control, and sets a new drive-control correction data.

At step S12, the CPU 146 stops each of the photoconductors 3*y*, 3*c*, 3*m*, and 3*bk* while synchronizing a phase of the photoconductors 3*y*, 3*c*, 3*m*, and 3*bk* using the new drive control correction data.

At step S13, the CPU 146 restarts a driving of process drive motors 120*y*, 120*c*, 120*m*, and 120*bk*.

At step S14, the CPU 146 conducts a second timing adjustment control.

The CPU 146 conducts such second timing adjustment control to correct an optical-writing starting timing for each of the photoconductors 3*y*, 3*c*, 3*m*, and 3*bk* because the optical writing starting timing may be in unfavorable timing condition due to the replacement of the process unit 1.

At step S15, the CPU 146 checks whether an error has occurred. If the CPU 146 confirms that the error has occurred at step S15, the process goes to the above-described steps S4 to S6, and the control process ends.

If the CPU 146 confirms that the error has not occurred at step S15, the process goes to step S16.

At step S16, the CPU 146 stops each of the process drive motors 120*y*, 120*c*, 120*m*, and 120*bk* for a phase adjustment control.

At step S17, the CPU 146 sets different linear velocities to each of the process drive motors 120*y*, 120*c*, 120*m*, and 120*bk* (i.e., setting of different linear velocities is set to ON). Then, the control process ends.

With such controlling process, the image forming apparatus 1000 may produce an image by reducing superimposing-deviation of images.

Hereinafter, a second exemplary embodiment of the present invention for the image forming apparatus 1000 is described.

Configurations of the image forming apparatus 1000 according to the second exemplary embodiment of the present invention are same as those of the image forming apparatus 1000 according to the first exemplary embodiment of the present invention.

The image forming apparatus 1000 according to the second exemplary embodiment of the present invention may employ the photoconductors 3*y*, 3*c*, 3*m*, and 3*bk* for forming yellow, cyan, magenta, and black toner images.

Each of the photoconductors 3*y*, 3*c*, 3*m*, and 3*bk* may have a circumferential length or cycle obtained by multiplying a dot formation pitch formed by a visible image forming unit including the optical writing unit 20 and the process units 1*y*, 1*c*, 1*m*, and 1*bk* in a rotation direction of a corresponding one of the photoconductors 3*y*, 3*c*, 3*m*, and 3*bk* with an integer number (e.g., one, two, three).

Specifically, the visible image forming unit included in the image forming apparatus 1000 may for an image having a resolution of 600 dpi. Accordingly, the visible image forming unit may form dots at a pitch of approximately 42 μm.

A circumferential length of each of the photoconductors 3*y*, 3*c*, 3*m*, and 3*bk* of the image forming apparatus 1000 according to the second exemplary embodiment of the present invention may be approximately 125.496 mm, for example. That is, the circumferential length of each of the photoconductors 3*y*, 3*c*, 3*m*, and 3*bk* may have a length 2988 times the dot formation pitch.

Specifically, the controller 200 may conduct a control for forming patches, which are a plurality of reference visible images in a speed deviation checking pattern image, in the rotation direction of the photoconductor 3 with the pitch Ps based on a timing that may be obtained by dividing the circumferential length of the photoconductor 3 by an integer number (e.g., one, two, three).

Specifically, the controller 200 may conduct a control for forming patches, which are a plurality of reference visible images in a speed deviation checking pattern image, in the rotation direction of the photoconductor 3 with the pitch Ps based on a timing that may be obtained by reducing the circumferential length of the photoconductor 3 by an integer number (e.g., one, two, three).

The image forming apparatus 1000 having the above-described configuration includes a photoconductor 3 having the circumferential length obtained by multiplying the dot formation pitch with an integer number (e.g., one, two, three).

Specifically, each of the photoconductors 3*y*, 3*c*, 3*m*, and 3*bk* may have a circumferential length of approximately 125.496 mm, for example. That is, the circumferential length of each of the photoconductors 3*y*, 3*c*, 3*m*, and 3*bk* may have a length 2988 times the dot formation pitch.

By employing such photoconductor, the pitch Ps of each patch in the speed deviation checking pattern image can be set to a value obtained by dividing the circumferential length of a photoconductor by an integer number (e.g., one, two, three).

The image forming apparatus 1000 may form each dot at a pitch of 36 times less than the circumferential length of the photoconductor 3. Accordingly, the pitch may be approximately 3.486 mm.

In such configuration of the image forming apparatus 1000, the controller 200 may not need to conduct a control for forming a first patch of each rotation cycle when the photoconductor 3 comes to a given rotational angle. Even without the above-described control, by forming a speed deviation checking pattern image having a plurality of patches arranged at equal pitches for revolutions of the photoconductor 3, the corresponding patches of the speed deviation checking pattern images for each revolution of the photoconductor 3 may be formed at respective same positions each other in a synchronized manner.

For example, a first patch for a first revolution of the photoconductor 3 and a first patch for a second revolution of the photoconductor 3, which is the 37th patch from the start of revolutions of the photoconductor 3, may be formed at the same position on the surface of the photoconductor 3 in the rotation direction of the photoconductor 3.

Therefore, the image forming apparatus 1000 may not need to conduct complex arithmetic processing for synchronizing speed data of each revolution of the photoconductor 3. Further, the image forming apparatus 1000 may not need to use a unit that may be expensive and have high responsibility for serving as the position sensors 135*y*, 135*c*, 135*m*, and 135*bk*.

The image forming apparatus 1000 can detect a speed deviation pattern of the photoconductor 3 with high accuracy, by only conducting simple arithmetic processing such as synchronous addition processing for removing speed deviation components.

Figure 20:
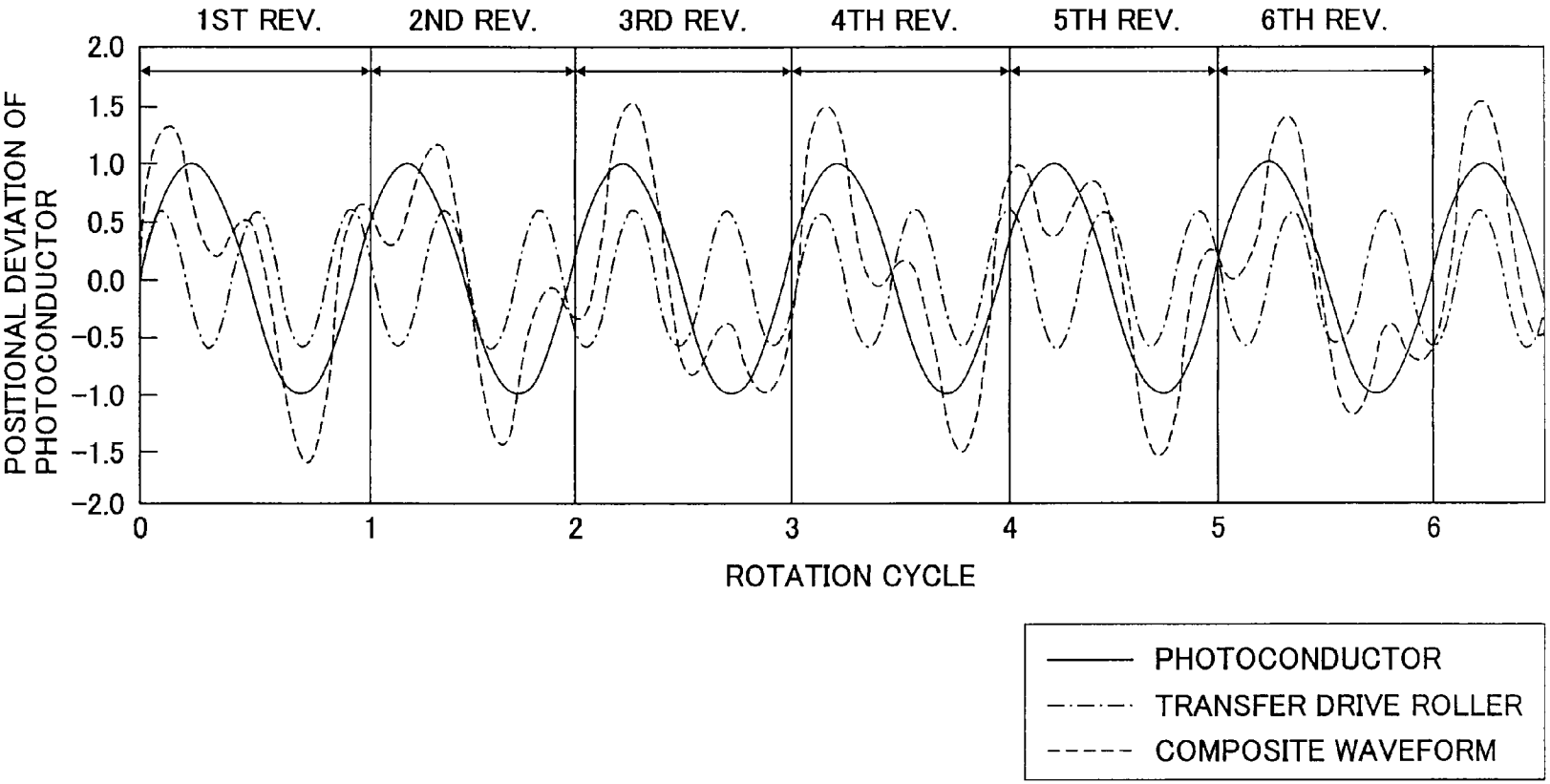
FIG. 20 is a graph showing a waveform of a positional deviation due to an eccentricity of a photoconductor, a waveform of a positional deviation due to a speed deviation of an image forming unit independent from the photoconductor, and a composite waveform of these waveforms.

FIG. 20 is a graph showing a waveform of the above-described positional deviation due to an eccentricity of the photoconductor 3, a waveform of the above—described positional deviation due to a speed deviation of an image forming unit, such as a transfer drive roller (e.g., the drive roller 47) independent from the photoconductor 3, and a composite waveform of these waveforms.

In the image forming apparatus 1000, in addition to the positional deviation due to a speed deviation component by an eccentricity of the photoconductor 3, the positional deviation due to a speed deviation component of an image forming unit other than the photoconductor 3 may occur.

The positional deviation due to a speed deviation component by an eccentricity of the photoconductor 3 may be shown as a waveform indicated by a solid line in FIG. 20.

The positional deviation due to a speed deviation component of an image forming unit other than the photoconductor 3 may be shown as a waveform indicated by a dashed-dotted line in FIG. 20.

The waveform indicated by a dashed-dotted line in FIG. 20 shows a positional deviation related to an eccentricity of a drive roller (e.g., the drive roller 47) that may drive the intermediate transfer belt 41 while supporting the intermediate transfer belt 41 in an extending manner.

These waveforms may be respectively represented as a speed deviation component due to an eccentricity of the photoconductor 3, a speed deviation component related to an image forming unit other than the photoconductor 3, and a composite version of these waveforms.

A speed detection pattern detected based on a detection timing of a speed deviation checking pattern image may have a same waveform as the composite waveform, which is indicated by a dashed line in FIG. 20.

To obtain a speed deviation component due to an eccentricity of the photoconductor 3, a speed deviation component due to an eccentricity of the drive roller 47 may need to be removed from the composite waveform.

The image forming apparatus 1000 according to the second exemplary embodiment of the present invention may use a synchronous addition processing as a method for removing a speed deviation component due to an eccentricity of the drive roller 47 from the composite waveform.

Specifically, in the image forming apparatus 1000 according to the second exemplary embodiment of the present invention, 36 patches may be formed in a speed deviation checking pattern image over the surface of the photoconductor 3 per one revolution of the photoconductor 3.

In the formation of 36 patches in a speed deviation checking pattern image, the image forming apparatus 1000 may obtain 36 sets of speed data for one revolution of the photoconductor 3.

For example, the image forming apparatus 1000 may obtain first speed data based on a time period from a detection of a first patch for a first revolution of the photoconductor 3 to a detection of a second patch for the first revolution, second speed data based on a time period from a detection of the second patch for the first revolution to a detection of a third patch for the first revolution, . . . 36th speed data based on a time period from a detection of a 36th patch for the first revolution of the photoconductor 3 to a detection of a first patch for a second revolution of the photoconductor 3.

In each rotation cycle, the first, second, . . . and 36th patches for the first revolution or rotation cycle may be formed at the same positions as which first, second, . . . and 36th patches for each of the other revolutions or rotation cycles may be formed. Accordingly, the first, second, . . . and 36th speed data for the first revolution may be synchronized with first, second, . . . and 36th speed data for each of the other revolutions.

Then, the synchronous addition processing may be conducted to add first speed data for each revolution of the photoconductor 3, second speed data for each revolution of the photoconductor 3, . . . 36th speed data for each revolution of the photoconductor 3, respectively, so that the speed deviation pattern for revolutions or rotation cycles of the photoconductor 3 may be converted to a speed deviation pattern for one revolution of the photoconductor 3.

Figure 21:
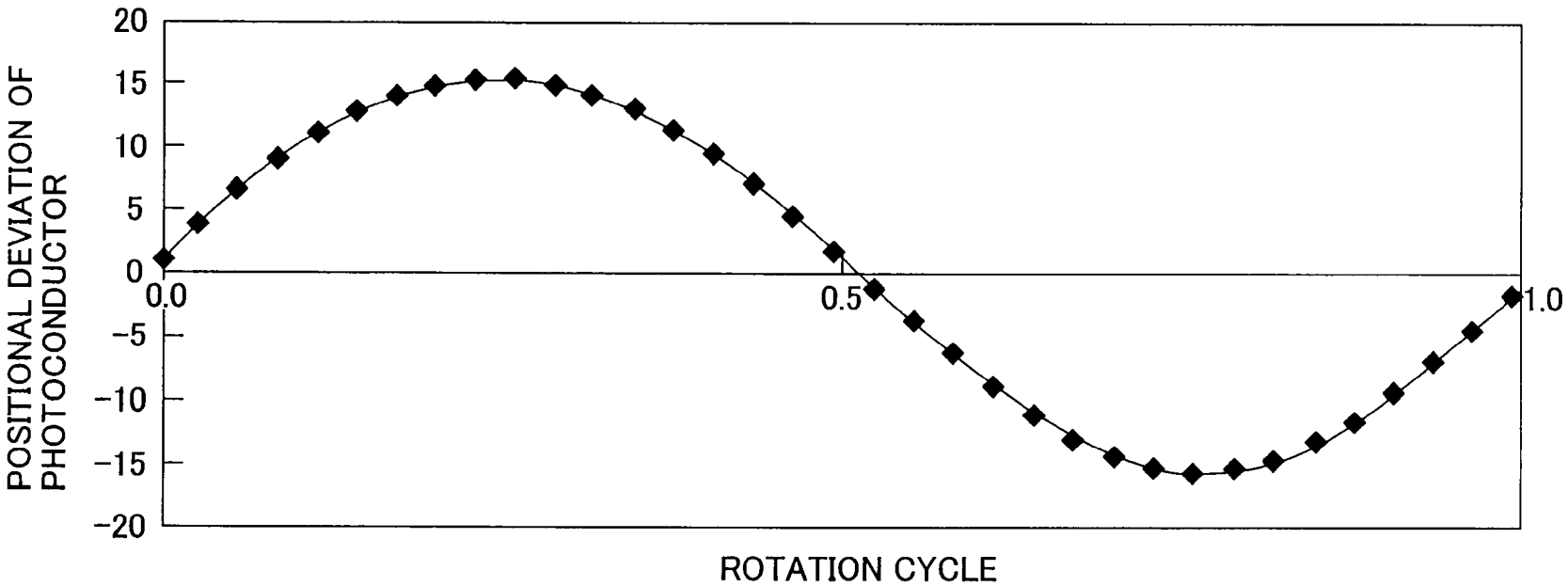
FIG. 21 is a graph showing a speed deviation pattern obtained by conducting synchronous addition processing to the composite waveform of FIG. 20.

Accordingly, as shown in FIG. 21, a speed deviation pattern for the first rotation cycle after the synchronous addition processing may not include a speed deviation component due to an eccentricity of the drive roller (e.g., the drive roller 47). That is, by removing a speed deviation component due to an eccentricity of the drive roller from the composite waveform shown in FIG. 20, a speed deviation pattern represented by a waveform shown in FIG. 21 may be obtained.

With such configuration, the image forming apparatus 1000 may not need to conduct complex arithmetic processing for synchronizing speed data of each revolution of the photoconductor 3 and/or may not need to use a unit that may be expensive and have high responsibility for serving as the position sensors 135*y*, 135*c*, 135*m*, and 135*bk*.

The image forming apparatus 1000 can detect a speed deviation pattern of the photoconductor 3 with high accuracy, by only conducting simple arithmetic processing such as synchronous addition processing for removing speed deviation components.

Further, a synchronous addition processing may need smaller memory capacity or storage capacity of the controller 200 when compared with storage capacity required for conducting a quadrature detection method.

For example, when using a quadrature detection method, 468 patches may be formed on a surface of a photoconductor, and be sequentially read by a sensor while rotating the photoconductor for 13 times, the entire 468 sets of speed data may need to be stored in a memory (e.g., the memory circuit 143) of the controller 200.

The number of revolutions of the photoconductor may be obtained by dividing the total number of patches formed on a surface of a photoconductor by the number of patches formed on the surface of the photoconductor per one revolution. For example, when the total number of patches formed on a surface of a photoconductor is 468 and the number of patches formed on the surface of the photoconductor per one revolution is 36, the number of revolutions of the photoconductor will be 13.

On the contrary, when a synchronous addition processing method is used, the controller 200 of the image forming apparatus 1000 may have a storage capacity sufficient for 36 sets of speed data of 36 patches for a first revolution because speed data of the following patches for a second and following revolutions can be added to the stored data.

The above-described explanation may relate to an image forming apparatus employing an indirect transfer method or an intermediate transfer method, in which respective single toner images of yellow, cyan, magenta, and black colors may be formed on the photoconductors 3*y*, 3*c*, 3*m*, and 3*bk* corresponding to the single toner images of yellow, cyan, magenta, and black colors, transferred onto the intermediate transfer belt 41 to form a full-color toner image, then transferred onto a recording medium as the full-color toner image.

As an alternative to the above-described indirect transfer method, an image forming apparatus may apply a direct transfer method, in which respective single toner images of yellow, cyan, magenta, and black colors may be formed on the photoconductors 3*y*, 3*c*, 3*m*, and 3*bk* corresponding to the single toner images of yellow, cyan, magenta, and black colors, then directly transferred in a sequential overlaying manner onto a recording medium carried on and by a sheet conveying member or belt formed in an endless shape.

In an image forming apparatus including the above-described direct transfer method, when a timing adjustment control or a speed deviation checking is conducted, each toner image may be transferred onto a sheet conveying member or belt and be detected by an optical sensor unit (e.g., the optical sensor unit 136).

As described above, the above-described image forming apparatus 1000 according the first and second exemplary embodiments of the present invention may include the controller 200 serving as a control unit. The controller 200 may conduct a control for obtaining a speed deviation checking pattern image that may have a length in a rotation direction of the photoconductor 3 greater than the circumferential length of the photoconductor 3 and that can be formed at a timing of which a whole plurality of patches of the speed deviation checking pattern image are arranged at equal intervals or pitches for revolutions of the photoconductor 3.

With such configuration, a speed deviation pattern per one revolution or rotation cycle of the photoconductor 3 can be detected with high accuracy, based on speed data for revolutions of the photoconductor 3.

Further, the image forming apparatus 1000 may include the optical sensor unit 136 serving as an image detecting unit.

The optical sensor unit 136 may detect patches of a speed deviation checking pattern image while the patches are separately transferred onto at least two different portions on a surface of the intermediate transfer belt 41 in a width direction or a direction perpendicular to a belt traveling direction of the intermediate transfer belt 41.

The controller 200 may form the patches of each speed deviation checking pattern image on the photoconductors 3*y*, 3*c*, 3*m*, and 3*bk* at a timing of which the speed deviation checking pattern images of at least two photoconductors of the photoconductors 3*y*, 3*c*, 3*m*, and 3*bk* may be transferred onto the surface of the intermediate transfer belt 41 on different lateral sides in a width direction or a direction perpendicular to the belt traveling direction of the intermediate transfer belt 41.

With such configuration, the speed deviation checking pattern images of the at least two photoconductors of the photoconductors 3*y*, 3*c*, 3*m*, and 3*bk* can be detected at the same time. Therefore, a speed of the above-described detection may be faster than a speed of detection when the speed deviation checking patterns are separately detected.

Further, the photoconductor 3*bk* for black may serve as a reference photoconductor among the four photoconductors 3*y*, 3*c*, 3*m*, and 3*bk*. Then, a speed deviation checking pattern image for black color may be a reference image among speed deviation checking pattern images for yellow, cyan, magenta, and black colors.

Therefore, each speed deviation checking pattern image formed on the photoconductors 3*y*, 3*c*, 3*m*, and 3*bk* may be transferred onto the surface of the intermediate transfer belt 41 so as to be arranged with the speed deviation checking pattern image for black corresponding to the photoconductor 3*bk* on different lateral portions in a width direction or a direction perpendicular to the belt traveling direction of the intermediate transfer belt 41.

With the above-described configuration, a speed deviation checking pattern image for black corresponding to the photoconductor 3*bk* and one of speed deviation checking pattern images for yellow, cyan, and magenta corresponding to the photoconductors 3*y*, 3*c*, and 3*m*, respectively, can be detected at the same time.

Further, the optical sensor unit 136 may include four or more optical sensors arranged at different positions in a width direction or a direction perpendicular to the belt traveling direction of the intermediate transfer belt 41 so as to detect the patches of the speed deviation checking pattern images of yellow, cyan, magenta, and black transferred on the surface of the intermediate transfer belt 41.

In a case in which the above-described optical sensor 136 conducts detection of the speed deviation checking pattern images, the patches of the speed deviation checking pattern images of yellow, cyan, magenta, and black may need to be transferred onto the surface of the intermediate transfer belt 41 in a width direction or a direction perpendicular to the belt traveling direction of the intermediate transfer belt 41.

With such configuration, the speed deviation checking pattern images of yellow, cyan, magenta, and black of the photoconductors 3*y*, 3*c*, 3*m*, and 3*bk* can be detected at the same time.

Further, the controller 200 may form the speed deviation checking pattern images for yellow, cyan, magenta, and black at a timing for arranging each leading edge of the speed deviation checking pattern images of yellow, cyan, and magenta corresponding to the photoconductors 3*y*, 3*c*, and 3*m*, respectively, and a leading edge of the speed deviation checking pattern image of black corresponding to the photoconductor 3*bk* at the respective same position on a surface of the intermediate transfer belt 41 in the belt traveling direction of the intermediate transfer belt 41.

With such configuration, as previously described, the speed deviation pattern of each of the photoconductors 3*y*, 3*c*, 3*m*, and 3*bk* may be detected with high accuracy, by removing the time-pitch error caused due to a speed of the intermediate transfer belt 41 at a position facing the optical sensor unit 136.

Furthermore, the speed deviation checking may be conducted after the following operations have been completed.

The controller 200 may start driving the process drive motors 120*y*, 120*c*, 120*m*, and 120*bk* serving as drive source, stop at the given reference timing based on a detection result obtained by the position sensors 135*y*, 135*c*, 135*m*, and 135*bk*, and further drive or restart the process drive motors 120*y*, 120*c*, 120*m*, and 120*bk*. After the above-described sequential operations have been complete, the speed deviation checking may be conducted.

In the above-described configuration, as previously described, the controller 200 can detect a positional deviation between the speed deviation checking pattern images of yellow, cyan, and magenta and the speed deviation checking pattern image of black, without referring to respective detection timings of the markings 134*y*, 134*c*, and 134*m*.

Further, the controller 200 may conduct the speed deviation checking by rotating the photoconductors 3*y*, 3*c*, 3*m*, and 3*bk* starting from a given rotational position. Accordingly, the speed deviation pattern of each of the photoconductors 3*y*, 3*c*, 3*m*, and 3*bk* may be detected while properly understanding a relationship of a rotational phase of the photoconductors 3*y*, 3*c*, 3*m*, and 3*bk*.

Accordingly, a phase deviation between the speed deviation checking pattern images of one of yellow, cyan, and magenta and the speed deviation checking pattern image of black can be easily obtained.

The above-described example embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. An image forming apparatus, comprising:

a plurality of image bearing members, each of which is configured to bear a portion of a pattern image including a plurality of reference images in a given form and each portion of the pattern image being arranged on the surface of each image bearing member in a rotation direction of each image bearing member;

an endless moving member disposed facing the plurality of image bearing members and configured to receive the pattern image from each of the plurality of image bearing members;

an image detecting unit configured to detect the plurality of reference images in the pattern image transferred onto the endless moving member;

a rotational angle detecting unit configured to separately detect each image bearing member when each image bearing member comes to a given rotational angle; and a controller configured to detect a speed deviation pattern per one revolution of each image bearing member based on a detection timing of each of the plurality of reference images by the image detecting unit and a detection result obtained by the rotational angle detecting unit and conduct a phase adjustment control for adjusting a phase of the speed deviation pattern of the plurality of image bearing members, wherein a circumferential length of each of the plurality of image bearing members in a rotation direction of each image bearing member is equal to a dot formation pitch in the rotation direction of each image bearing member multiplied with a first integer number, and the controller is configured to control forming the reference images in the pattern image at a timing that the reference images of the pattern image are formed in a rotation direction of each image bearing member such that a pitch of the pattern image is obtained by dividing the circumferential length of each image bearing member by a second integer number.

2. The image forming apparatus according to claim 1, wherein the controller is configured to detect the speed deviation pattern based on the detection result obtained by the rotational angle detecting unit and a result of synchronously adding multiple speed data information for each revolution of each image bearing member, the multiple speed data information determined from a result of detecting the plurality of reference images in the pattern image transferred onto the endless moving member.

3. The image forming apparatus according to claim 1, wherein the controller is configured to control formation of the pattern image having a circumferential length thereof in the rotation direction of each image bearing member greater than the circumferential length of each image bearing member, at a timing that the plurality of reference images in the pattern image are arranged at equal pitches in the rotation direction of each image bearing member.

4. The image forming apparatus according to claim 1, wherein:

the image detecting unit is configured to detect the plurality of reference images of the pattern image while the plurality of reference images are separately transferred onto at least two different portions on the surface of the endless moving member in a direction perpendicular to a traveling direction of the endless moving member, and the controller is configured to control transfer of the plurality of reference images of the pattern image from the surface of each image bearing member onto the surface of the endless moving member, at a timing that respective portions of the pattern image of at least two image bearing members of the plurality of image bearing members are transferred onto the surface of the endless moving member on different lateral sides in the direction perpendicular to the traveling direction of the endless moving member.

5. The image forming apparatus according to claim 4, wherein:

the plurality of image bearing members include one reference image bearing member, and each of the portions of the pattern image corresponding to respective image bearing members other than the reference image bearing member among the plurality of image bearing members is arranged with a portion of the pattern image corresponding to the reference image bearing member on a different lateral side in the direction perpendicular to the traveling direction of the endless moving member.

6. The image forming apparatus according to claim 5, wherein:

the image detecting unit includes a plurality of sensors of an equal or greater number of the plurality of image bearing members so that the plurality of sensors are configured to detect the plurality of reference images of the pattern image at different positions in the direction perpendicular to the traveling direction of the endless moving member on the surface of the endless moving member, and the controller is configured to control formation of the pattern images on the surface of a corresponding image bearing member of the plurality of image bearing members on different lateral portions in the direction perpendicular to the traveling direction of the endless moving member.

7. The image forming apparatus according to claim 5, wherein the controller is configured to control formation of the portions of the pattern image at a timing that a leading edge of the portion of the pattern image corresponding to the reference image bearing member and respective leading edges of the portions of the pattern image corresponding to each image bearing member other than the reference image bearing member of the plurality of image bearing members are arranged at respective same positions on the surface of the endless moving member in the traveling direction of the endless moving member.

8. The image forming apparatus according to claim 7, further comprising:

a plurality of drive sources, each of which is configured to drive one of the plurality of image bearing members, wherein the controller is configured to start the plurality of drive sources, stop the plurality of drive sources at a given reference timing based on the detection result obtained by the rotational angle detecting unit, restart the plurality of drive sources, and conduct the speed deviation checking.

9. The image forming apparatus according to claim 1, wherein the plurality of reference images in the pattern image is a plurality of line image patterns comprising a plurality of colors.

10. The image forming apparatus according to claim 9, wherein each of the plurality of line image patterns are inclined with respect to a traveling direction of the endless moving member.

* * * * *